US005970302A

United States Patent [19]

Yamane

[11] Patent Number: 5,970,302

[45] Date of Patent: Oct. 19, 1999

[54] METHOD OF CLEANING IN ELECTROPHOTOGRAPHIC PRINTER

[75] Inventor: Tsutomu Yamane, Tokyo, Japan

[73] Assignee: Oki Data Corporation, Tokyo, Japan

[21] Appl. No.: 09/163,398

[22] Filed: Sep. 30, 1998

[30] Foreign Application Priority Data

Oct. 1, 1997 [JP] Japan ..... 9-286043

[51] Int. Cl.[6] ..... G03G 21/00

[52] U.S. Cl. ..... 399/343; 399/50; 399/115; 399/174; 399/357

[58] Field of Search ..... 399/50, 115, 168, 399/174, 176, 343, 357, 359; 361/214, 215; 430/125

[56] References Cited

U.S. PATENT DOCUMENTS 5,701,570 12/1997 Takuma ..... 399/343
5,765,076 6/1998 Ogata et al. ..... 399/168
5,768,653 6/1998 Fare ..... 399/50
5,822,657 10/1998 Hisada et al. ..... 399/343 X

*Primary Examiner*—Arthur T. Grimley
*Assistant Examiner*—Hoan Tran
*Attorney, Agent, or Firm*—Rabin & Champagne, P.C.

[57] ABSTRACT

A method of cleaning is used to remove residual toner in an electrophotographic printer. After a printing operation, some amount of normally-charged toner and reversely-charged toner is left on the photoconductive drum and rollers such as charging rollers, transfer roller, and cleaning roller in contact with the photoconductive drum. A potential difference is applied between two members, for example, the cleaning roller and the photoconductive drum in electrical contact with each other so as to cause the residual toner to migrate from one member to the other. The potential differences are applied at specific timings so that the residual toner migrates properly onto the rotating photoconductive drum and is carried to the developing section for reuse.

5 Claims, 17 Drawing Sheets

71
5
21
10
5
-1350V
-1700V
-800V AFTER PASSING "21"
0 TO +100V BEFORE PASSING "21"

t0~t6
10
51
DRUM SURFACE IS
0 TO -100V AFTER
PASSING "51"

t1~t9
10
3
63b
I
61
-1350V
0V BEFORE PASSING "61"
-800V AFTER PASSING 61"

t2~t3(T1),t5~t9
10
3
21
71
5
0V
-1350V
-800V BEFORE & AFTER PASSING "21"

t3~t5(T2)

t4~t7(T2)

t6~t8(T2)

t1~t9 t8~t9(T3)

t1~t10 t0~t6 t2~t3(T1),t5~t11 t3~t5(T2)

t4~t7(T2)

t6~t8(T2)

t1~t10
10
5
63b
61
-1350V
0 TO +100V
BEFORE
PASSING "61"
-800V AFTER
PASING "61"

t8~t9(T3)
10
5
51
52
-1200V
I
DRUM SURFACE IS
-800V BEFORE &
AFTER PASSING "51"

t9~t12
10
51
5
52
+1000V
I
DRUM SURFACE IS
-800V BEFORE PASSING "51" &
0 TO +100V AFTER PASSING "51"

t10~t12 t11~t12(T5)

t7~t12 t20~t25 t21~t30 t22~t23(T11)

t23~t26(T12)

t24~t27(T12)

t25~t28(T12)

t21~t30 t26~t31 t27~t32,t33~t34 t28~t29(T13)

t28~t29(T13)

t29~t34 t30~t34 t31~t34 t32~t33(T14)

METHOD OF CLEANING IN ELECTROPHOTOGRAPHIC PRINTER

BACKGROUND OF THE INVENTION

1. Field of the Invention

The present invention relates to a method of cleaning various parts in an electrophotographic printer and more particularly to a cleaning method where residual toner on the photoconductive drum of an electrophotographic printer is removed at predetermine timings.

2. Description of the Related Art

With an electrophotographic printer, the surface of a photoconductive drum is uniformly charged by a charging section, exposed to image light to have an electrostatic latent image formed thereon. The latent image is then developed with toner into a toner image. The toner image is transferred to print paper with the aid of Coulomb force. Sometimes, the toner on the photoconductive drum may be left not transferred to the print paper and is carried to the exposing section. If the photoconductive drum is exposed to another image light with such residual toner left on the photoconductive drum, normal exposure to subsequent image light is impaired. Thus, there is provided a cleaning section which removes the toner from the photoconductive drum with the aid of Coulomb force.

The aforementioned conventional printer suffers from the following problem. Toner left on the photoconductive drum after the transfer operation includes residual normally-charged toner with which an electrostatic latent image was developed into a toner image, and reversely-charged toner of a polarity opposite to the normally-charged toner. The cleaning roller is opposite in polarity to the normally-charged toner. Thus, the normally-charged toner migrates to the cleaning roller due to Coulomb force that acts in a direction from the photoconductive drum to the cleaning section.

The cleaning roller is of the same polarity as the charges of the reversely-charged toner so that the cleaning roller repels the reversely charge toner. Thus, the surface of the photoconductive drum passes the cleaning section with the reversely-charged toner left thereon. When the reversely-charged toner reaches the charging section, the reversely-charged toner is attracted to the charging section since the charging roller is opposite in polarity to the charges of the reversely-charged toner. The reversely-charged toner accumulates on the charging roller, causing unstable charging of the surface of the photoconductive drum.

SUMMARY OF THE INVENTION

A method of cleaning is used to remove residual toner in an electrophotographic printer. The residual toner includes reversely-charged toner and normally-charged toner. The reversely-charged toner is opposite in polarity to the normally-charged toner.

A charging section charges a photoconductive drum. The charging section has a main charging device and an auxiliary charging device. The main charging device has a first area in electrical contact with the photoconductive drum and a second area in electrical contact with the auxiliary charging device.

When a printing operation is being performed, potential differences are applied among the main charging device, the auxiliary charging device, and the photoconductive drum. The potential differences are such values that reversely-charged toner deposited on the photoconductive drum migrates from the photoconductive drum to the main charging device via the first area by Coulomb force and then the reversely charged toner migrates from the main charging device to the auxiliary charging device via the second area by Coulomb force.

When a cleaning has been started, a potential difference is applied between the auxiliary charging device and the main charging device. The potential difference is such that the reversely charged toner deposited on the auxiliary charging device migrates from the auxiliary charging device to the main charging device via the second area by Coulomb force. Then, a potential difference is applied between the photoconductive drum and the main charging device so that the reversely charged toner deposited on the main charging device migrates from the main charging device to the photoconductive drum via the first area by Coulomb force. When the reversely-charged toner is deposited on the surface of the photoconductive drum due to Coulomb force and reaches the cleaning section as the photoconductive drum rotates, a potential difference is applied between the photoconductive drum and the cleaning section having a third area in electrical contact with the photoconductive drum. This potential difference is such that the reversely-charged toner migrates from the photoconductive drum to the cleaning section via the third area by Coulomb force.

The normally-charged toner may migrate from the main charging device to the auxiliary charging device during the cleaning operation, and may remain deposited on the auxiliary charging device. Thus, a potential difference is applied between the main charging device and the auxiliary charging device so that the normally charged toner migrates from the auxiliary charging device to the main charging device. Then, a potential difference is applied between the main charging device and the photoconductive drum so that the normally-charged toner now migrates to the photoconductive drum. The normally charged toner is then delivered to the developing section. Then, a potential difference is applied between the photoconductive drum and the developing section so that the normally-charged toner is recovered into the developing section.

The normally-charged toner may migrate from the photoconductive drum to the transfer section when the normally-charged toner passes the transfer section as the photoconductive drum rotates, and may remain deposited on the transfer section. Thus, a potential difference is applied between the photoconductive drum and the transfer section so that the normally-charged toner migrates from the transfer roller to the photoconductive drum. Then, the normally-charged toner approaches the cleaning section as the photoconductive drum rotates. Then, a potential difference is applied between the cleaning section and the photoconductive drum so that the normally-charged toner migrates to the cleaning section.

During a cleaning operation, a potential difference is applied between the cleaning roller and the photoconductive drum so that the normally-charge toner migrates from the cleaning roller to the photoconductive drum. The normally-charged toner approaches the developing section as the photoconductive drum rotates. The normally-charged toner is recovered into the developing section.

The reversely-charged toner is inverted in polarity by triboelectrification and recovered into the developing toner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

Voltages described in the specification include positive and negative voltages. It is assumed in the specification that the voltages are related as follows:

If a positive voltage +V1 (e.g., +400) is more positive than another positive voltage +V2 (e.g., +100), then it is assumed +V1 is higher than +V2. If a negative voltage −V3 (e.g. −1700 V) is more negative than another negative voltage −V4 (e.g., −1350 V), then −V3 is lower than −V4. If a positive voltage +V5 (e.g., +100 V) is more positive than a negative voltage −V6 (e.g., −1350 V), then +V5 is higher than −V6.

First Embodiment

<Construction>

Figure 1:
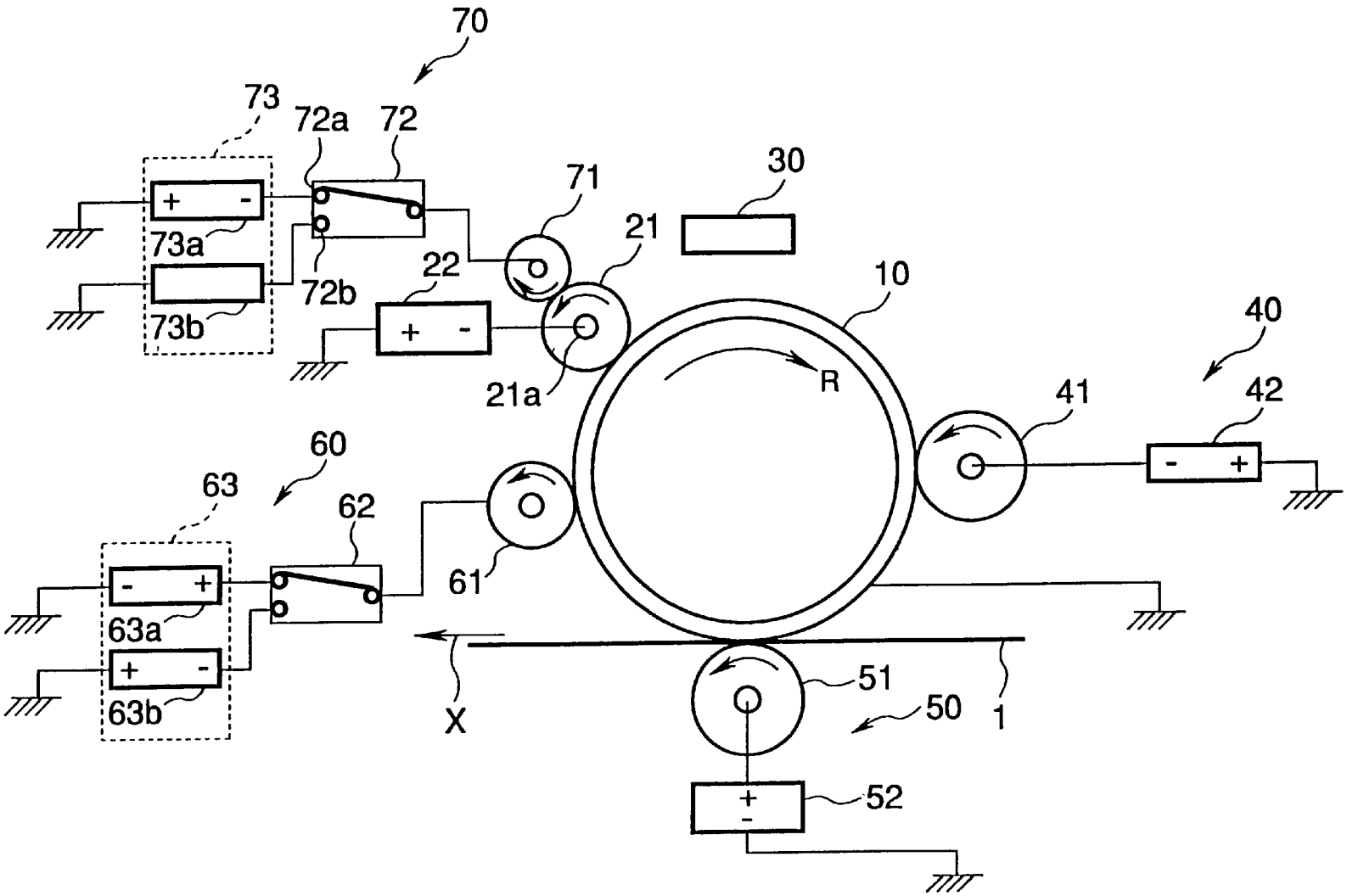
FIG. 1 is a cross-sectional view of an electrophotographic printer.

FIG. 1 is a cross-sectional view of an electrophotographic printer. Just like ordinary electrophotographic printers, an exposing section 30, developing section 40, transfer section 50, cleaning section 60, and charging section 70 are disposed around a photoconductive drum 10. As the photoconductive drum 10 rotates in a direction shown by arrow R, the surface of the drum 10 goes through charging, exposing, developing, and transfer processes, thereby performing a printing operation.

The photoconductive drum 10 is, for example, an aluminum cylinder with a negative-charge type photoconductive material applied thereon. The exposing section 30 includes light-emitting diode array that illuminates the surface of the photoconductive drum 10 in accordance with image data received from a signal processing section, not shown to form an electrostatic latent image on the surface of the photoconductive drum 10.

The developing section 40 has a developing roller 41 connected to a power supply circuit 42. The developing roller 41 is formed of a semiconductive rubber. The power supply circuit 42 provides a potential to the developing roller 41, the potential being much lower than that of areas on the surface of the photoconductive drum 10 exposed to image light. The developing roller 41 has a thin layer of toner on its outer circumferential surface and brings the toner layer into contact with the photoconductive drum 10, thereby developing the electrostatic latent image into a toner image.

The toner is, for example, negatively charged toner. In this specification, the term "normally-charged toner" is used to cover toner supplied from the developing roller 41 to the photoconductive drum 10 to develop the electrostatic latent image. The term "reversely-charged toner" is used to cover toner having charges of a polarity opposite to that of the normally-charged toner. In principle, the normally-charged toner can be either positive or negative. In the embodiments, the electrophotographic printer will be described with respect to normally-charged toner of negative polarity. If the normally-charged toner is positive polarity, the following description can be read with all the polarities reversed.

The transfer section 50 has a transfer roller 51. Paper 1 is pulled in between the photoconductive drum 10 and the transfer roller 51 so that the paper 1 travels in a direction shown by arrow X. The transfer roller 51 receives a potential higher than that of the surface of the photoconductive drum 10 from the power supply circuit 52. As a result, the toner image on the photoconductive drum 10 is attracted to the paper 1 with the aid of Coulomb force. Thus, the toner image is transferred to the paper 1 and subsequently fused in a fixing section, not shown.

The cleaning section 60 includes a cleaning roller 61. The cleaning roller 61 is selectively connected to a positive power supply circuit 63*a* and a negative power supply circuit 63*b* via a switch 62. The switch 62 is shifted to the power supply circuit 63*a* during normal printing operation and switched between the power supply circuit 63*a* and the power supply circuit 63*b* at predetermined timings during cleaning operation.

The charging section 70 includes a main charging roller 21 and an auxiliary charging roller 71. The main charging roller 21 is made of a semiconductive rubber which is in direct electrical contact with the photoconductive drum 10. The auxiliary charging roller 71 is a metal roller which is in electrical contact with the main charging roller 21, so that the auxiliary charging roller 71 is in indirect contact with the photoconductive drum 10. The main charging roller 21 receives a negative voltage from the power supply circuit 22 so as to charge the surface of the photoconductive drum 10 to a negative potential. The power supply circuit 22 is a constant voltage source that outputs a voltage of −1350 volts, so that the surface of the photoconductive drum 10 is charged to −800 volts.

The auxiliary charging roller 71 is selectively connected either to a power supply circuit 73*a* or to a resistor 73*b* by a switch 72. The power supply circuit 73*a* outputs a negative voltage of about −1700 to −1800 volts. The power supply circuit 73*a* is a constant current source that operates to supply a constant current from the photoconductive drum 10 via the main charging roller 21 to the auxiliary charging roller 71 when the main charging roller 21 charges the surface of the photoconductive drum 10 during the printing operation. The resistor 73*b* is used to maintain the auxiliary charging roller 71 at a potential close to the ground. The switch 72 connects the power supply circuit 73*a* to the auxiliary charging roller 71 during printing operation, and connects the resistor 73*b* to the auxiliary charging roller 71 at predetermined timings during cleaning operation.

<Printing Operation>

The printing operation of the apparatus of FIG. 1 will be described. FIGS. 2A–2D are cross-sectional views of the apparatus, showing potentials on the photoconductive drum and various rollers in contact with the photoconductive drum.

Figure 2A:
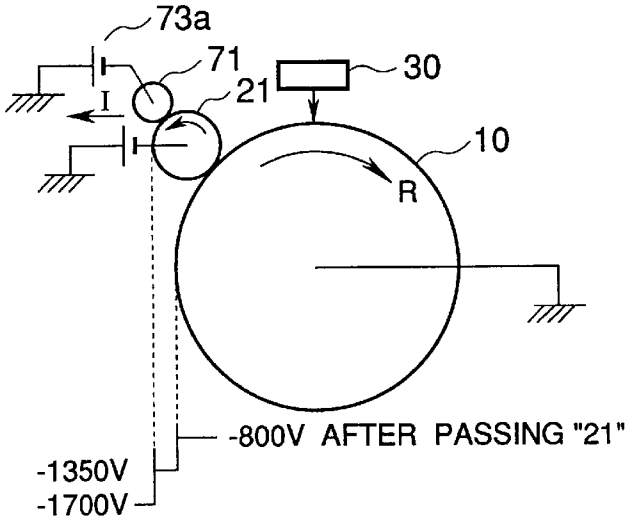
FIGS. 2A–2D are cross-sectional views of the apparatus showing potentials on the photoconductive drum and various rollers in contact with the photoconductive drum.

Upon starting a printing operation, the main charging roller 21 receives a voltage of −1350 volts from the power supply circuit 22 as shown in FIG. 2A, so that the surface of the photoconductive drum is charge to −800 V. The auxiliary charging roller 71 receives a voltage of −1700 to −1800 volts from the power supply circuit 73*a*. As the photoconductive drum 10 rotates in the direction shown by arrow R, the uniformly charged surface of the photoconductive drum 10 reaches the exposing section 30 which illuminates the charged surface of the photoconductive drum 10 to form an electrostatic latent image thereon.

Figure 2B:
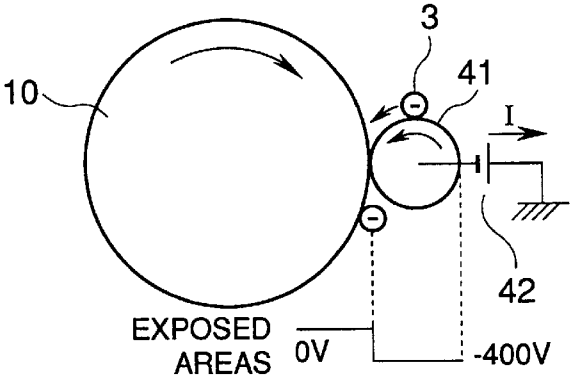

Areas of the surface of the photoconductive drum illuminated by the image light become nearly zero volts. The electrostatic latent image reaches the developing section 40 as the photoconductive drum rotates in the direction shown by arrow R. As shown in FIG. 2B, the developing roller 41 of the developing section 40 rotates in pressure contact with the photoconductive drum 10.

The developing roller 41 receives a negative voltage of −400 V from the power supply circuit 42, the negative voltage being somewhat lower than that of areas on the surface of the photoconductive drum 10 exposed to image light. Thus, the normally-charged toner 3 deposited on the developing roller 41 is attracted to the areas of nearly zero volts on the surface of the photoconductive drum 10. As a result, a toner image is formed on the photoconductive drum 10. After the developing process, the photoconductive drum 10 further rotates so that the toner image reaches the transfer section 50.

Figure 2C:
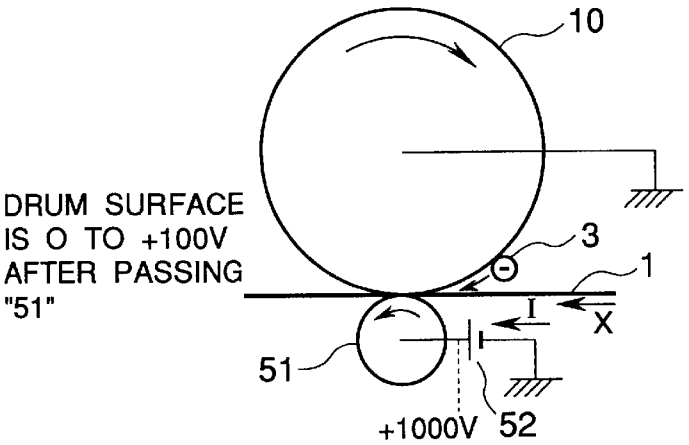

As shown in FIG. 2C, the transfer roller 51 receives a positive voltage of +1000 V from the power supply circuit 52. The paper 1 is pulled in between the photoconductive drum 10 and the transfer roller 51, and travels in the direction shown by arrow X. The normally charge toner 3 that forms the toner image is attracted to the transfer roller 51 with the aid of Coulomb force, so that the toner image is transferred onto the paper 1. After the transfer process, the paper 1 is directed to the fixing section, not shown, where the toner image is fused into a permanent print. The normally-charged toner that forms the toner image should be thoroughly transferred onto the paper 1, but a small amount of the toner is left on the surface of the photoconductive drum 10.

Figure 2D:
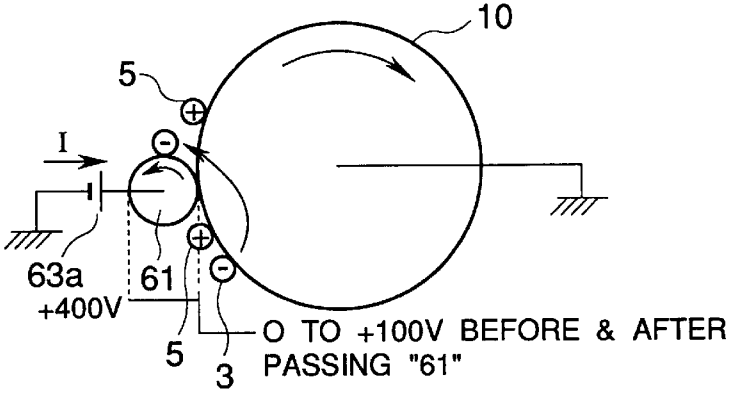

The residual toner includes, as shown in FIG. 2D, two kinds of charged toner; the first is normally-charged toner 3 that failed to be transferred to the paper 1, and the second is reversely-charged toner 5 which is produced when the normally-charged toner receives positive charges from the transfer roller 51 during the transfer process. The photoconductive drum 10 rotates with the two kinds of toner clinging to the surface of the photoconductive drum 10 and reaches the cleaning section 60 shown in FIG. 1. As shown in FIG. 2D, the cleaning roller 61 of the cleaning section 60 receives a positive high voltage of +400 V from the power supply circuit 63*a*. Therefore, the normally-charged toner 3 on the photoconductive drum 10 is attracted to the cleaning roller 61 with the aid of Coulomb force, thereby removing the normally-charged toner 3 from the photoconductive drum 10.

The reversely-charged toner 5 is opposite in polarity to the normally-charged toner 3 and therefore the surface of the photoconductive drum 10 passes the cleaning section with the reversely-charged toner 5 remaining on the surface. As is clear from FIG. 2A, the main charging roller 21 receives a negative voltage of −1350 V so that the reversely-charged toner 5 arriving at the charging section migrates from the photoconductive drum 10 to the main charging roller 21 due to Coulomb force. There will be no discharge between the cleaning roller and the photoconductive drum.

A primary object of the invention is to prevent the print quality from being deteriorated due to the reversely-charged toner which migrates to the main charging roller 21.

<Operation of the First Embodiment>

Figure 3:
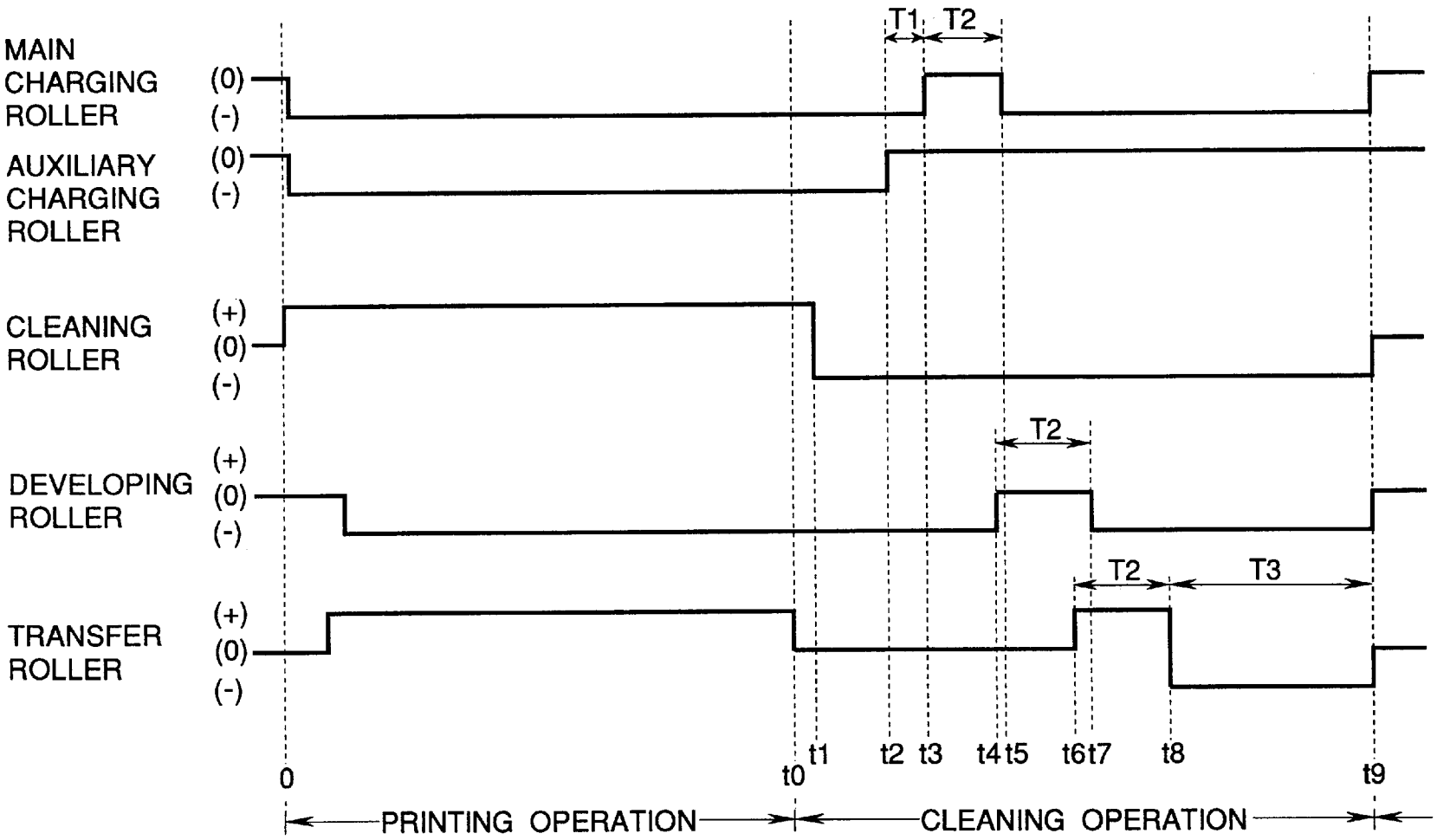
FIG. 3 is a timing chart illustrating the operation of the electrophotographic printer according to the first embodiment.

FIG. 3 is a timing chart illustrating the operation of the electrophotographic printer according to the first embodiment.

The cleaning operation of the first embodiment will be described with reference to FIGS. 4A–4D, 5A–5D, and 6.

FIGS. 4A–4D, 5A–5D, and 6 illustrate the states of the respective parts at timings shown in FIG. 3.

Figures 4A, 4B, 4C, 4D:
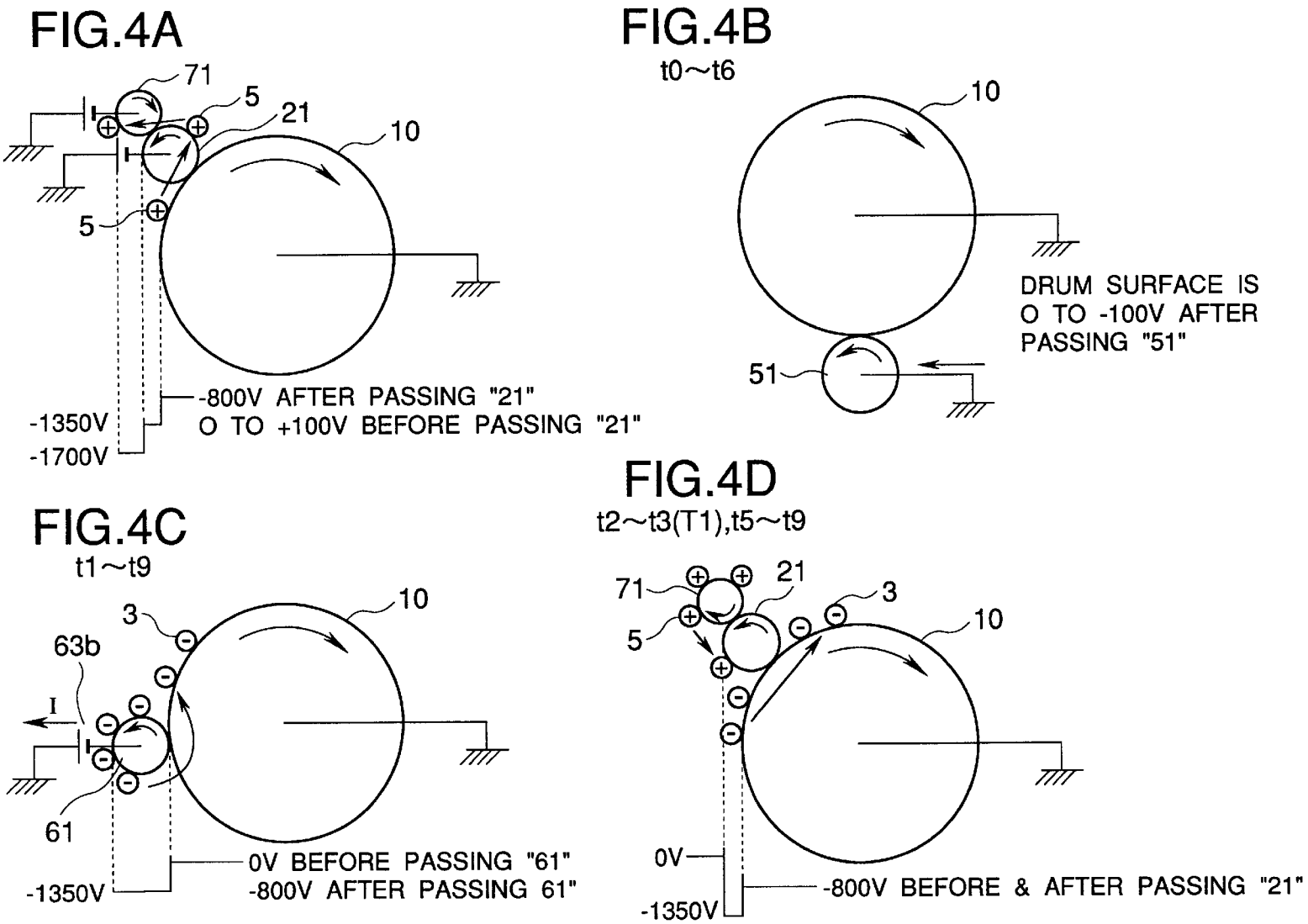
FIGS. 4A–4D, 5A–5D, and 6 illustrate the conditions of the respective parts at timings shown in the timing chart shown in FIG. 3.

Referring to FIG. 4A, the reversely-charged toner 5 left on the photoconductive drum 10 during a printing operation migrates from the photoconductive drum 10 to the main charging roller 21 due to the fact that the main charging roller 21 receives a negative voltage of −1350 V. The auxiliary charging roller 71 receives a voltage of −1700 V, more negative than the main charging roller 21 and is under a constant current control so that a constant current flows from the photoconductive drum 10 via the main charging roller 21 to the auxiliary charging roller 71. Thus, the reversely-charged toner 5 having positive charges migrates to the main charging roller 21 and then further migrates to the auxiliary charging roller 71 with the aid of Coulomb force. In this manner, the outer surface of the main charging roller 21 is cleaned at all time so that the main charging roller 21 can properly charge the surface of the photoconductive drum 10 to a constant potential.

Performing printing operations with this condition, a large amount of the reversely-charged toner 5 is deposited on the surface of the auxiliary roller 71 and clumps, thereby gradually causing the functions of the auxiliary charging roller 71 to deteriorate. In order to prevent such deterioration of the auxiliary roller 71, the cleaning operation is performed after time t0 shown in FIG. 3.

FIG. 4B shows the transfer roller 51 immediately after the cleaning operation has started. The power supply circuit 52 shown in FIG. 1 is turned off, so that the transfer roller 51 receives zero volts. Thus, the charges on the surface of the photoconductive drum 10 in contact with the transfer roller 51 are discharged to nearly zero volts. The transfer roller 51 is maintained at this potential until time t6. As the photoconductive drum 10 rotates, the area on the surface of the photoconductive drum 10 which is now zero volts reaches the cleaning section 60 shown in FIG. 1.

As shown in FIG. 4C, the cleaning roller 61 is connected to the power supply circuit 63*b* at time t1 so that the cleaning roller 61 receives a negative voltage of −1350 V. The cleaning roller 61 holds the normally-charged toner 3 thereon which has migrated from the photoconductive drum 10 to the cleaning roller 61 during printing operation. Since the surface potential of the photoconductive drum 10 is zero volts and the cleaning roller 61 is maintained at a negative potential, the normally-charged toner 3 migrates to the photoconductive drum 10 due to Coulomb force and is deposited on the photoconductive drum 10. The potential of the cleaning roller 61 is maintained at this negative (−1350 V) potential till t9 at which the cleaning operation completes.

FIG. 4D illustrates the normally-charged toner 3 when the surface on which the normally-charged toner 3 is deposited has moved to the charging section. At time t2, the auxiliary charging roller 71 is switched to nearly zero volts. In other words, the resistor 73*b* is connected to the auxiliary charging roller 71 via the switch 72. The main charging roller 21 has been connected to the negative voltage of −1350 V since the beginning of the printing operation. Therefore, the reversely-charged toner 5 deposited on the auxiliary roller 71 migrates to the main charging roller 21 due to Coulomb force. This state continues for a duration T1. The duration T1 is such that the auxiliary charging roller 71 completes its one rotation so that all of the reversely-charged toner 5 on the auxiliary charging roller 71 migrates to the main charging roller 21.

The surface of the photoconductive drum 10 on which the normally-charged toner 3 is deposited, passes the charging section with the normally-charged toner 3 deposited thereon since the surface potential of the photoconductive drum 10 is higher than the main charging roller 21. The surface of the photoconductive drum 10 in contact with the cleaning roller 61 is charged to a voltage of −800 volts.

Figure 5A:
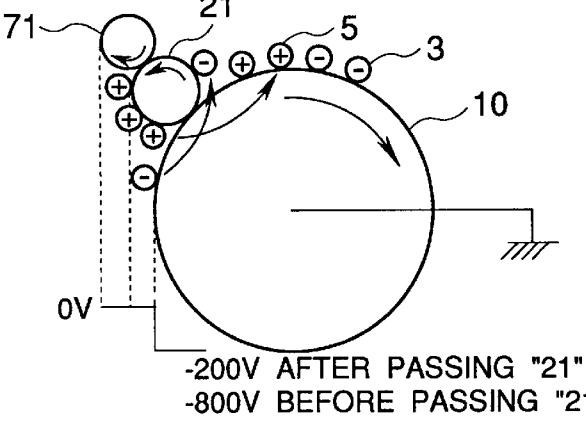

At time t3, the power supply circuit 22 connected to the main charging roller 21 is turned off so that the potential of the main charging roller 21 is switched to zero volts as shown in FIG. 5A. As is described, the surface potential of the photoconductive drum 10 has been charged to −800 volts by the cleaning roller 61 and therefore the reversely-charged toner 5 on the main charging roller 21 migrates to the photoconductive drum 10 with the aid of Coulomb force. In this manner, the surface of the photoconductive drum 10 now holds the reversely-charged toner 5 in addition to the normally-charged toner 3.

The state shown in FIG. 5A will last for a duration T2 as shown in FIG. 3. The Duration T2 is a length of time such that the main charging roller 21 rotates at least one complete rotation and all of the reversely-charged toner 5 on the main charging roller 21 migrates to the photoconductive drum 10. The reversely-charged toner 5 and normally-charged toner 3 on the photoconductive drum 10 reach to the developing section as the photoconductive drum rotates.

Figure 5B:
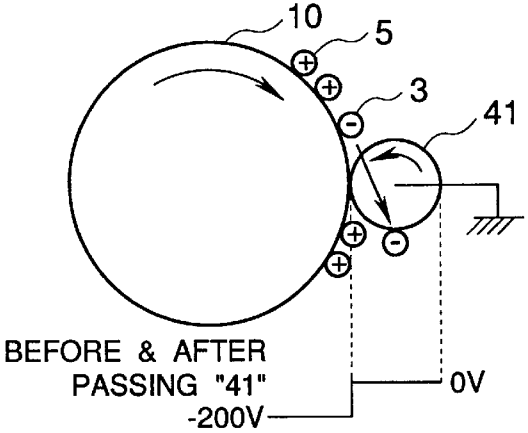

As shown in FIG. 5B, at time t4, the power supply circuit 42 shown in FIG. 1 connected to the developing roller 41 is turned off so that the developing roller 41 receives zero volts. Since the surface potential of the photoconductive drum 10 is −200 volts, the normally-charged toner 3 on the photoconductive drum 10 migrates to the developing roller 41 with the aid of Coulomb force. In this manner, the normally-charged toner 3 left on the photoconductive drum 10 is recovered to the developing section and again used as developer toner.

The reversely-charged toner 5 is opposite in polarity to the normally-charged toner 3. Thus, the reversely-charged toner 5 deposited on the surface of the photoconductive drum 10 passes the developing section. The developing roller 41 continues to receive zero volts at least for the duration T2. In this manner, the state shown in FIG. 5B will continue till all of the reversely-charged toner 5 on the photoconductive drum 10 has passed the developing section for the duration T2. This prevents the reversely-charged toner 5 from entering the developing section.

Figure 5C:
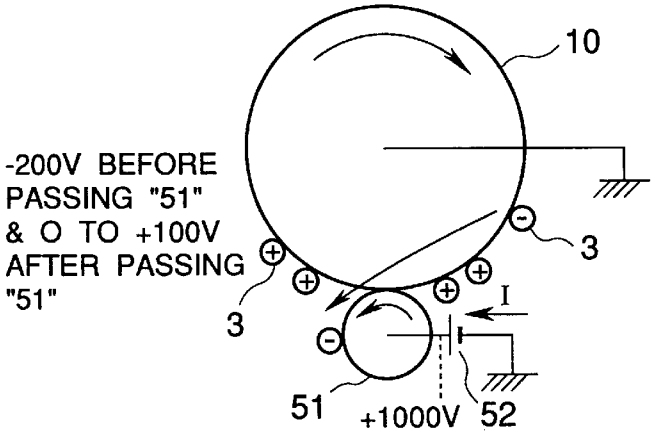

As shown in FIG. 5C, the transfer roller 51 of the transfer section receives a positive voltage of +1000 V for the duration T2 (i.e., t6–t8). This maintains the transfer roller 51 at a higher potential than the photoconductive drum 10 so that the reversely-charged toner 5 will not be deposited on the surface of the transfer roller 51. A small amount of normally-charged toner 3 which was not recovered into the developing section and left on the photoconductive drum 10 will migrate to the transfer roller 51 due to Coulomb force.

Figure 5D:
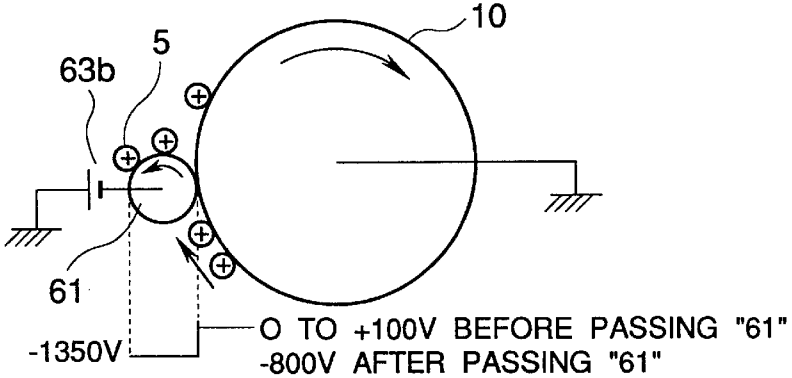

As shown in FIG. 5D, reversely-charged toner 5 on the photoconductive drum 10 reaches to the cleaning section and brought into contact with the cleaning roller 61. The cleaning roller 61 has been supplied with a negative voltage of −1350 V from the power supply circuit 63*b* while the surface of the photoconductive drum 10 has been maintained at a potential higher than the cleaning roller 61. Therefore, the reversely-charged toner 5 migrates to the cleaning roller 61 due to Coulomb force, so that the reversely-charged toner 5 is removed from the surface of the photoconductive drum 10.

Figure 6:
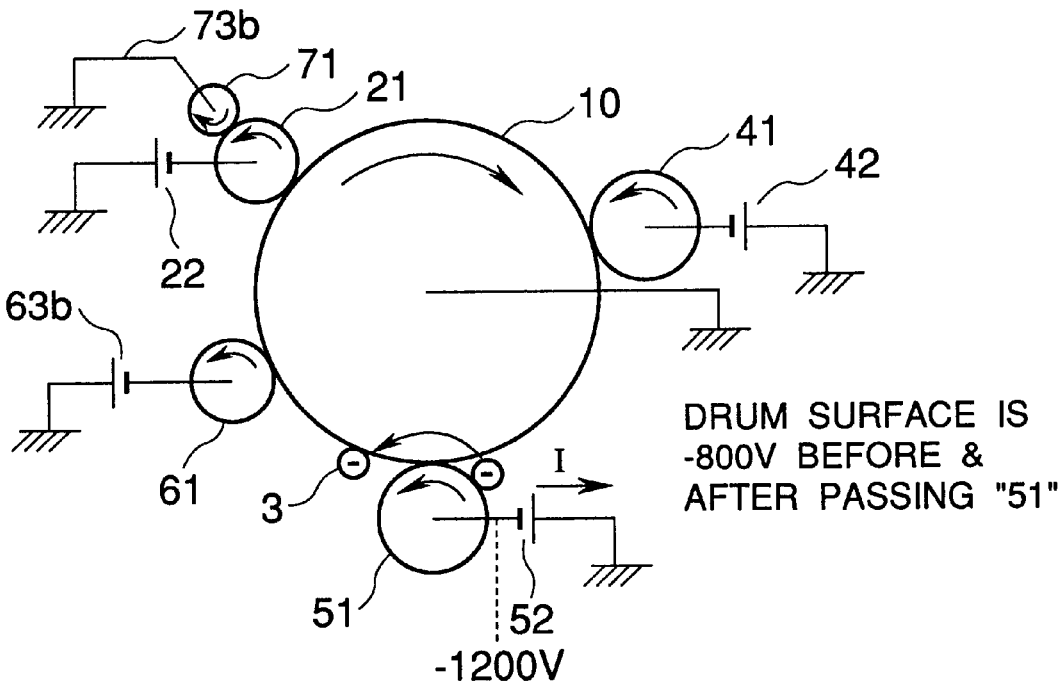

As shown in FIG. 3, the transfer roller 51 receives a negative voltage (−1200 V) from the power supply circuit 52 for a duration T3 (i.e., t8-t9). The duration T3 is a length of time required for the transfer roller 51 to rotate through at least one complete rotation, so that all of the normally-charged toner 3 deposited on the transfer roller 51 migrates to the photoconductive drum 10 with the aid of Coulomb force as shown in FIG. 6. In this manner, the transfer roller 51 is cleaned. This prevents any normally-charged toner left on the transfer roller 51 from adhering to the reverse side of the paper during the subsequent printing operation.

<Advantages of the First Embodiment>

As described above, the reversely-charged toner 5 that has migrated from the photoconductive drum 10 to the main charging roller 21 is attracted to the auxiliary charging roller 71, thereby cleaning the surface of the main charging roller 21. Therefore, stable charging of the photoconductive drum 10 can be effected by the main charging roller 21. The reversely-charged toner 5 on the auxiliary charging roller 71 is attracted to the photoconductive drum 10 when the cleaning process is performed. This way of cleaning the reversely-charged toner 5 prevents the function of the auxiliary roller 21 from being impaired by the reversely-charged toner deposited to the surface of the auxiliary charging roller 71.

The migration of the reversely-charged toner prevents the particles of reversely-charged toner from clumping together. Some of the reversely-charged toner can be triboelectrically inverted into normally-charged toner when the reversely-charged toner deposited on the auxiliary charging roller is subjected to friction between the auxiliary charging roller and the main charging roller during the rotation of the auxiliary charging roller and the main charging roller or when the reversely-charged toner migrates from the auxiliary charging roller to the main charging roller, thereby allowing the toner to be reused.

Second Embodiment

Figure 7:
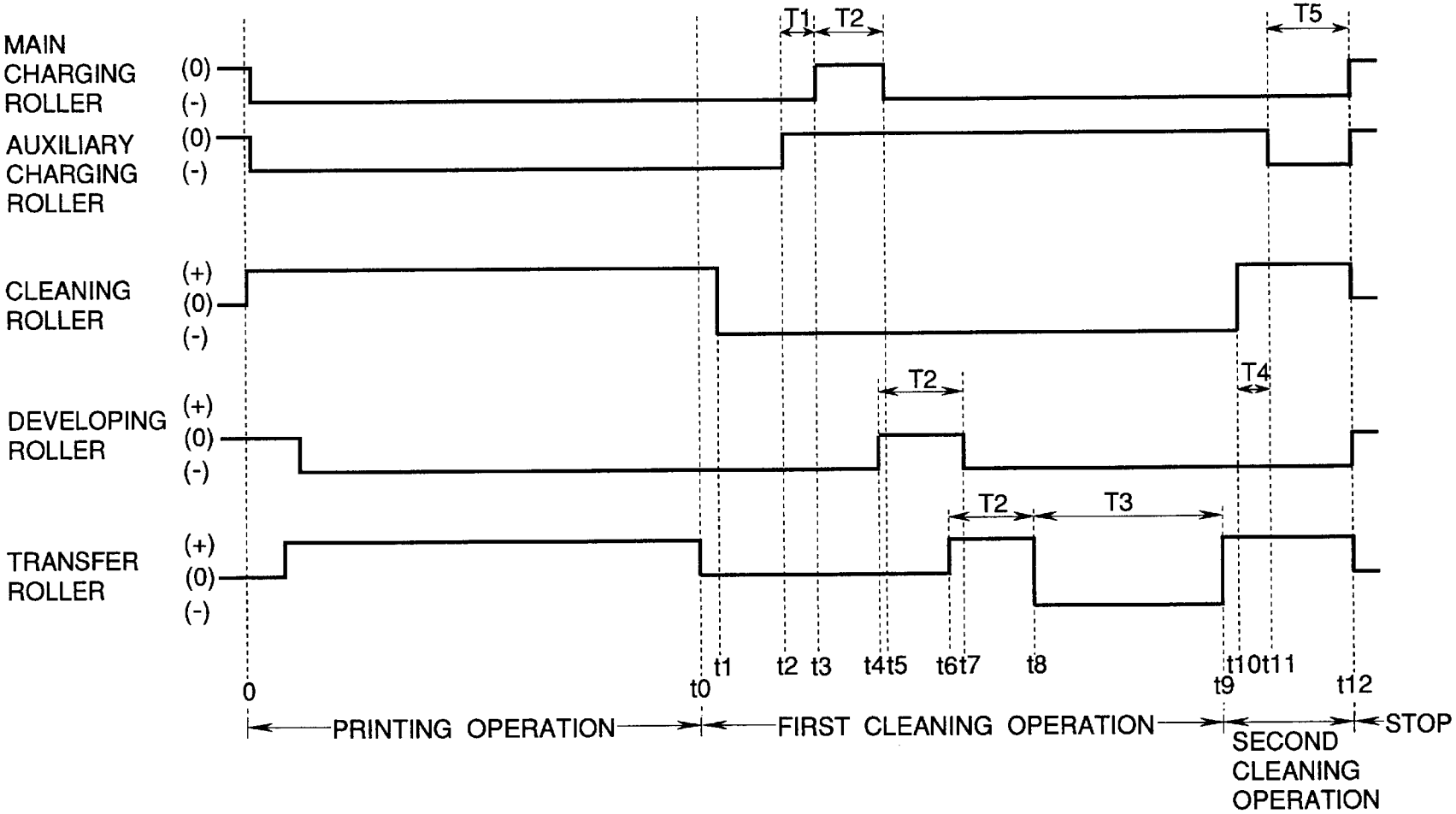
FIG. 7 is a timing chart illustrating the operation of an electrophotographic printer according to a second embodiment.

FIG. 7 is a timing chart illustrating the operation of an electrophotographic printer according to a second embodiment.

In the second embodiment, the operation from time t0 to time t9 is referred to as a first cleaning operation and the operation from time t9 to time t12 is referred to as a second cleaning operation. The first cleaning operation is the same as the operation described in the first embodiment with reference to FIG. 3. The second embodiment differs from the first embodiment in that the second cleaning operation is performed after the first cleaning operation.

In the first embodiment, after having completed the printing operation of one page, the reversely-charged toner 5 is removed from the auxiliary charging roller 71 and urged to migrate to the photoconductive drum 10, so that the reversely-charged toner 5 is not clumped on the auxiliary charging roller 71. However, if the transfer efficiency of the transferring section is rather low, so that a significant amount of the normally-charged toner 3 is left on the photoconductive drum 10, the print paper is soiled as described later. In order to solve this drawback, the second cleaning operation is performed in the second embodiment.

Figure 8B:
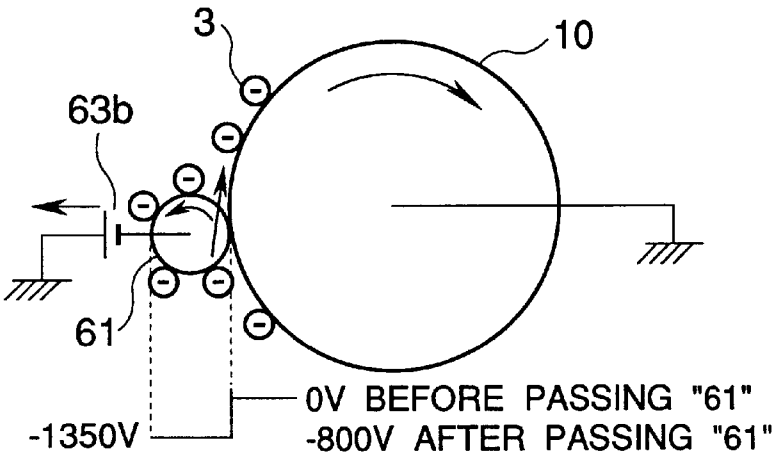
FIGS. 8A–8B, 9A–9D, 10A–10C, and 11A–11C illustrate the relationships between the photoconductive drum and the respective rollers at specific timings shown in FIG. 7.
Figure 8A:
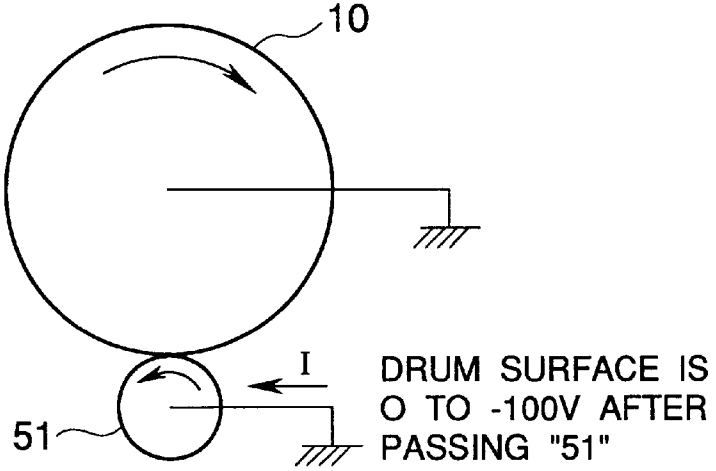

FIGS. 8A-8B, 9A–9D, 10A–10C, and 11A–11C illustrate the relationships between the photoconductive drum and the respective rollers at specific timings shown in FIG. 7. FIGS. 8A-8B and 9A–9D show the same relationships as in the cleaning operation performed in the first embodiment. However, the residual toner is more than that in the first embodiment and therefore the conditions in which toner accumulates are somewhat different. As shown in FIG. 8A, the transfer roller 51 is grounded from time t0 to time t6. As shown in FIG. 8B, the cleaning roller 61 is supplied with a negative voltage of −1350 V from the power supply circuit 63*b* from time t1 to t10. With the conditions shown in FIGS. 8A and 8B, the normally-charged toner 3 migrates from the cleaning roller 61 to the photoconductive drum 10, thus the normally-charged toner 3 deposited on the cleaning roller 61 is delivered to and recovered into the developing section as described in the first embodiment.

Figure 9A:
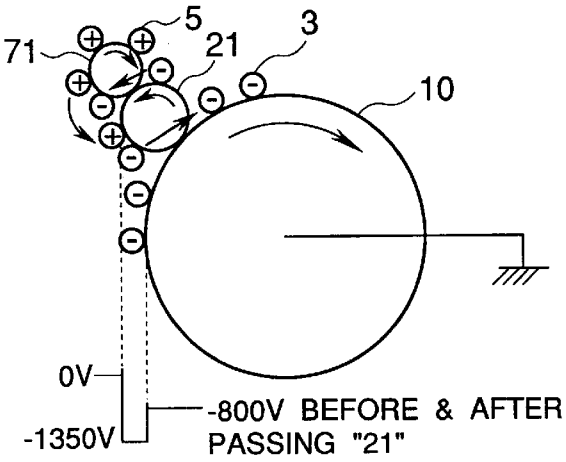

As shown in FIG. 9A, as the photoconductive drum 10 rotates, the normally-charged toner 3 that has migrated from the cleaning roller 61 to the photoconductive drum 10 passes through the charging section while at the same time the reversely-charged toner 5 migrates from the auxiliary charging roller 71 to the main charging roller 21. In this manner, the normally-charged toner deposited on the cleaning roller 61 is delivered to and recovered into the developing section as described in the first embodiment.

Figure 9B:
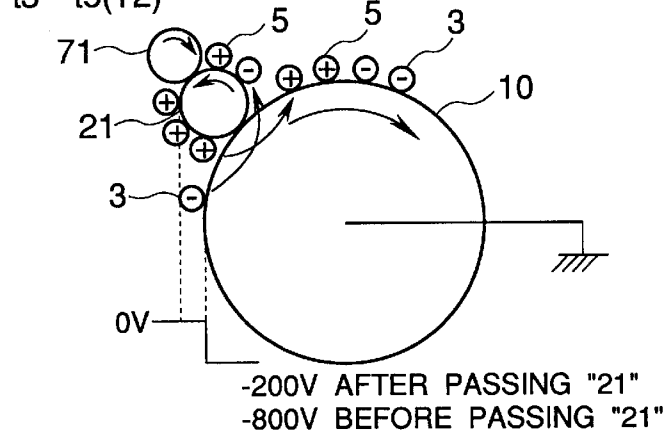

Then, as shown in FIG. 9B, when the main charging roller 21 is grounded at the next timing, the reversely-charged toner 5 migrates from the main charging roller 21 to the photoconductive drum 10 with the aid of Coulomb force.

If the normally-charged toner 3 remains deposited on the photoconductive drum 10, the normally-charged toner 3 migrates from the photoconductive drum 10 to the main charging roller 21 since the main charging roller 21 receives a voltage of zero volts, higher than the surface of the photoconductive drum 10. In other words, the reversely-charged toner 5 migrates from the main charging roller 21 to the photoconductive drum 10 while the normally-charged toner 3 migrates from the photoconductive drum 10 to the main charging roller 21. Thereafter, the potential of the main charging roller 21 is switched to a potential lower than that of the auxiliary charging roller 71 after time t5 so that the normally-charged toner 3 migrates from the main charging roller 21 to the auxiliary charging roller 71. Upon starting the printing operation, the normally-charged toner 3 migrates again from the auxiliary charging roller 71 to the main charging roller 21 and then from the main charging roller 21 to the photoconductive drum 10. Therefore, if the amount of the normally-charged toner 3 is small, then the normally-charged toner 3 is recovered into the developing section and is not detrimental to print quality. However, if the amount of the normally-charged toner 3 is large, then the normally-charged toner 3 obstructs the image light emitted from the exposing section, deteriorating the print quality. Thus, this large amount of residual normally-charged toner 3 is recovered by a later described manner.

Figure 9C:
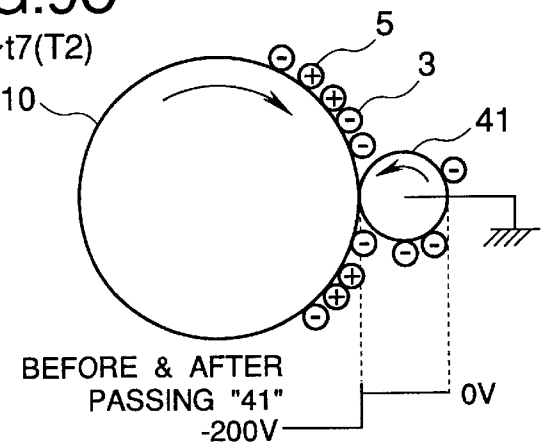

The normally-charged toner 3 adhering to the surface of the photoconductive drum 10 reaches to the developing section as shown in FIG. 9C. The normally-charged toner 3 is brought into contact with the developing roller 41 so that the normally-charged toner 3 migrates to the developing roller 41 with the aid of Coulomb force. In this manner, the normally-charged toner 3 is recovered.

If the amount of residual normally-charged toner 3 is too large, one complete rotation of the photoconductive drum 10 may not be enough to completely recover the residual normally-charged toner 3 to the developing roller 41. The result is that the surface of photoconductive drum 10 passes the developing section with some normally-charged toner 3 left on the photoconductive drum 10.

Figure 9D:
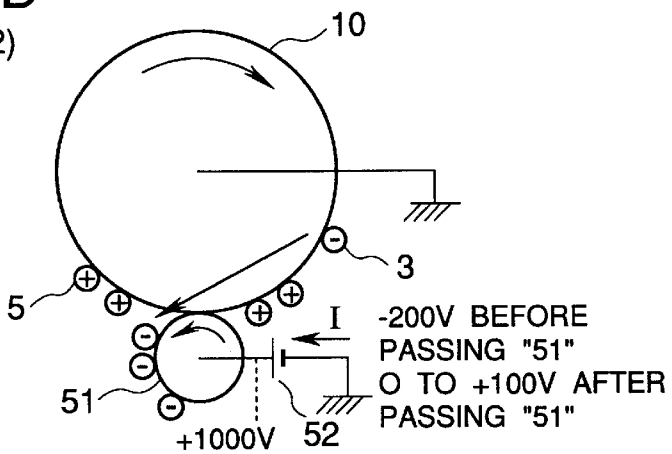

Thereafter, as shown in FIG. 9D, the normally-charged toner 3 and the reversely-charged toner 5 deposited on the photoconductive drum 10 are then brought into contact with the transfer roller 51 which has been set to a higher potential than the photoconductive drum 10. Thus, the reversely-charged toner 5 passes the transfer section while the normally-charged toner 3 migrates to the transfer roller 51.

Figures 10A, 10B, 10C:
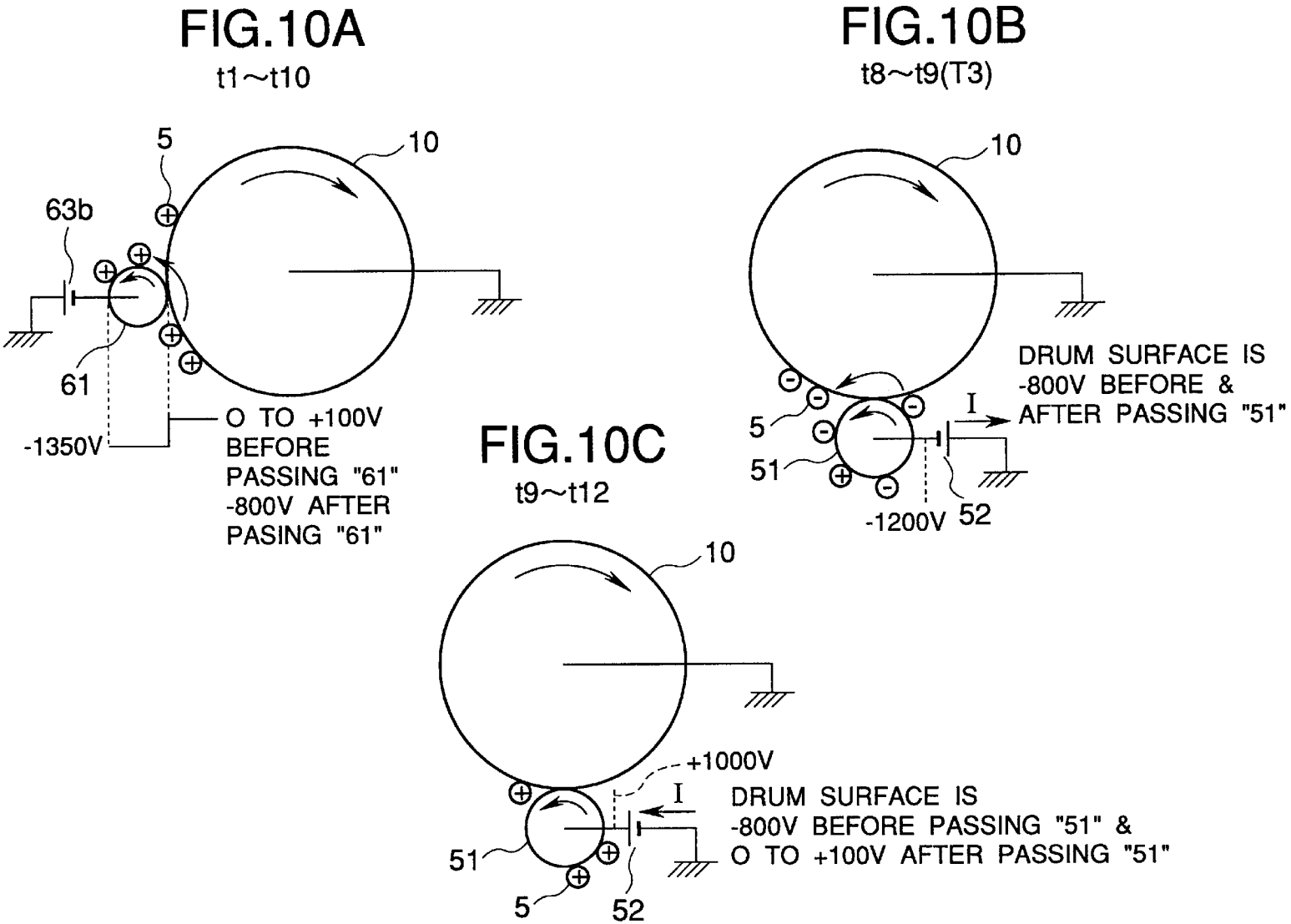

As shown in FIG. 10A, the reversely-charged toner 5 carried to the cleaning section migrates to the cleaning roller 61 with the aid of Coulomb force. If the next printing operation is started with this condition, the paper 1 is pulled in between the photoconductive drum 10 and the transfer roller 51 as shown in FIG. 1, the normally-charged toner 3 that has migrated to the transfer roller 51 will adhere to the reverse side of the paper 1 and then will be fused so that the reverse side of the paper 1 will be contaminated by toner. In order to prevent such a problem, a voltage lower than the surface of the photoconductive drum 10 is applied to the transfer roller 51 for the duration time T3 (i.e., t8-t9), as shown in FIG. 10B, during which the transfer roller 51 rotates through at least one complete rotation so that the normally-charged toner 3 deposited on the transfer roller 51 migrates to the photoconductive drum 10 with the aid of Coulomb force. The normally-charged toner 3 that has migrated from the transfer roller 51 to the photoconductive drum 10 is mainly recovered into the developing section. Some reversely-charged toner may migrate to the transfer roller 51 during application of a negative voltage to the transfer roller 51 from time t8 time t9. therefore, the power supply circuit 52 is switched from the negative to a positive voltage of +1000 V as shown in FIG. 10C, so that the transfer roller 51 receives a voltage of +1000 V from time t9 to time t12.

Figure 11A:
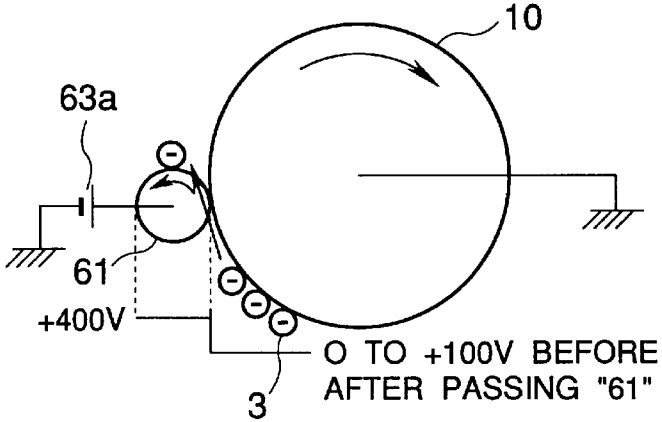

At time t10 after the duration T3, the switch 62 is switched to supply a positive voltage of +400 V to the cleaning roller 61 as shown in FIG. 11A. Thus, the normally-charged toner 3 on the photoconductive drum 10 migrates to the cleaning roller 61 with the aid of Coulomb force.

Figure 11B:
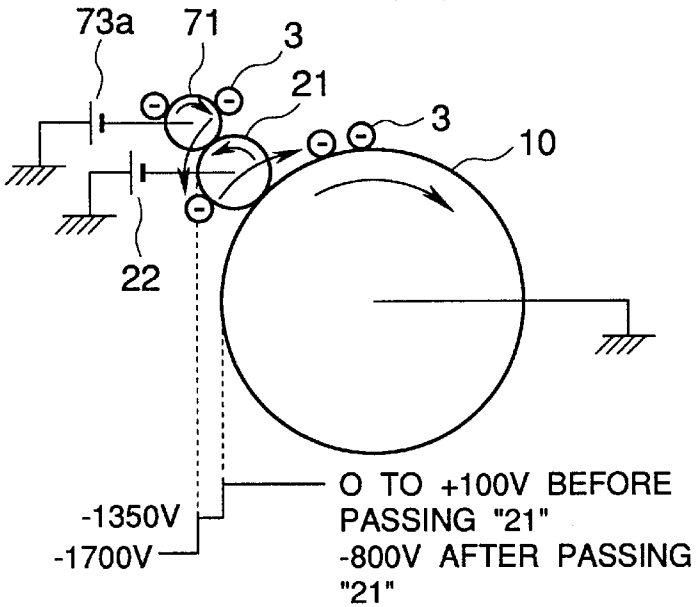
Figure 11C:
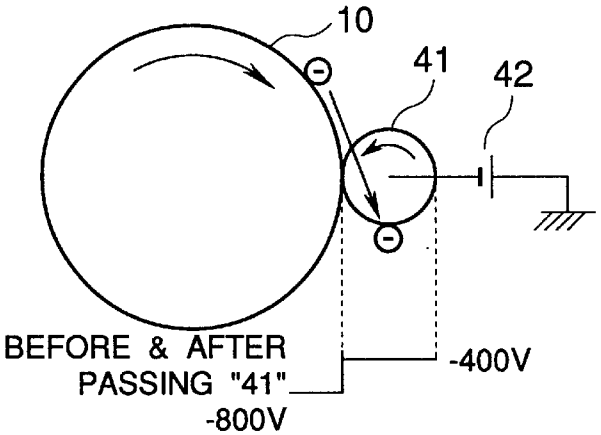

In the meantime, as shown in FIG. 11B, when the potential of the auxiliary charging roller 71 is switched at time t11, the recovery operation of the normally-charged toner 3 accumulated on the auxiliary charging roller 71 is started. As shown in FIG. 11B, the switch 72 is switched to connect the power supply circuit 73*a* to the auxiliary charging roller 71 so that the potentials of the auxiliary charging roller 71, main charging roller 21, and photoconductive drum 10 are increasingly higher in this order. As a result, the normally-charged toner 3 deposited on the surface of the auxiliary charging roller 71 migrates from the auxiliary charging roller 71 via the main charging roller 21 to the photoconductive drum 10.

In the meantime, the cleaning roller 61 receives a positive voltage (+400 V) at time t10, and therefore the potential of the photoconductive drum 10 has increased to nearly zero volts. A duration T4 (i.e., t10-t11) should be selected to be longer than the time required for the surface of the photoconductive drum 10 to reach the charging section after the surface has been brought into contact with the cleaning roller 61. Thus, the potential of the surface of the photoconductive drum 10 is higher than that of the main charging roller 21 so as to ensure that the normally-charged toner 3 migrates from the auxiliary charging roller 71 via the main charging roller 21 to the photoconductive drum 10.

The state shown in FIG. 11B will last for at least a duration T5 (t11-t12). The duration T5 is a first time period plus a second time period. The first time period is a time required for the auxiliary roller 71 to rotate through more than one complete rotation so that the normally-charged toner 3 deposited on the auxiliary charging roller 71 migrates via the main charging roller 21 to the photoconductive drum 10. The second time period is a time required for the normally-charged toner 3 that has migrated to the photoconductive drum 10 to reach the developing section as the photoconductive drum 10 rotate. The normally-charged toner 3 deposited on the auxiliary charging roller 71 is removed therefrom and carried on the photoconductive drum 10 to the developing section where the normally-charged toner 3 is completely recovered by the developing roller 41.

<Advantages of the Second Embodiment>

When performing the first cleaning operation where the reversely-charged toner 5 deposited on the auxiliary charging roller 71, a side effect is that the normally-charged toner 3 adheres to the auxiliary charging roller 71 and causes a deteriorated print quality in the next printing operation. According to the second embodiment, performing the second cleaning operation allows that the normally-charged toner 3 migrates from the auxiliary charging roller 71 via the main charging roller 21 to the photoconductive drum 10 and is recovered into the developing section, thereby preventing the print quality from deteriorating. In addition, an operation may be added where the normally-charged toner 3 is recovered from the transfer section to the developing section.

Third Embodiment

Figure 12:
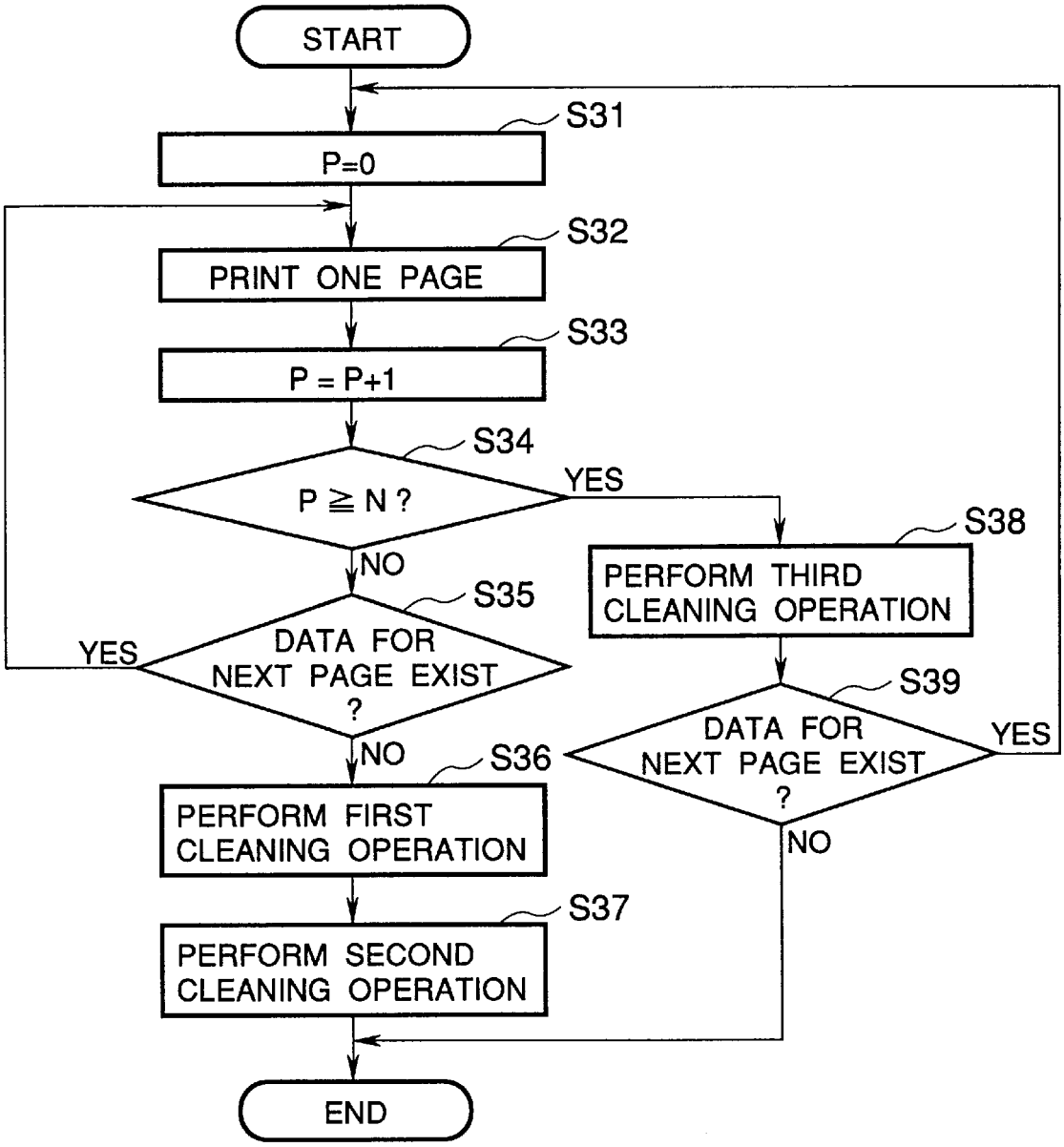
FIG. 12 is a flowchart illustrating the operation of an electrophotographic printer according to a third embodiment.

FIG. 12 is a flowchart illustrating the operation of an electrophotographic printer according to a third embodiment. The cleaning operations in the first and second embodiments are performed upon completion of printing of all the pages of a print job. Continuously printing a large number of pages can cause the reversely-charged toner 5 to be accumulated on the auxiliary charging roller 71, deteriorating the function of the auxiliary charging roller 71. This in turn causes deteriorated print quality. In order to solve this drawback, in the third embodiment, the printing operation is monitored so that a cleaning operation is performed at predetermined timings before the reversely-charged toner 5 accumulates on the auxiliary charging roller 71.

As shown in the flowchart, at step S31, a parameter P is initialized. The parameter P is a variable used to determine when a cleaning operation should be performed. The parameter P is counted up by one every time one page has been printed. In other words, at step S32, after printing one page, the parameter P is incremented. Then, at step S34, a check is made to determine whether the parameter P has reached a predetermined value N. For example, if N is assumed to be 10, then every time ten pages have been printed, the program proceeds to step S38 where a third cleaning operation is performed.

If P is less than N, the program proceeds to step S35 where a check is made to determine whether the print data for the next page exists; if the answer is YES, then the program loops back to step S32 for printing the next page.

Upon completion of printing of all the pages, the program proceeds to step S36 where the first cleaning operation is performed. Then, at step S37, the second cleaning operation is performed. The step S37 is not essential and may be performed or omitted as required.

If the answer is YES at step S34, the program proceeds to step S38 where the third cleaning operation is performed. The third cleaning operation is that illustrated by the timing chart in FIG. 13. Then, a check is made at step S39 to determine whether the print data for the next page exists. If the print data for the next page exists, then the program proceeds to step S31 where the parameter P is again reset. In other words, the cleaning operations are performed for every ten pages without regard to the total number of pages of a job. This way of cleaning prevents excess reversely-charged toner 5 from building up on the auxiliary roller 71.

As described above, the parameter P implies an amount of reversely-charged toner 5 built up on the auxiliary roller 71. This parameter can be, for example, the number of pages as shown in FIG. 12 or the number of rotation of the photoconductive drum 10 or other rollers. The parameter P can be monitored using an appropriate means and the cleaning operations can be performed when the parameter reaches a predetermined value.

Figure 13:
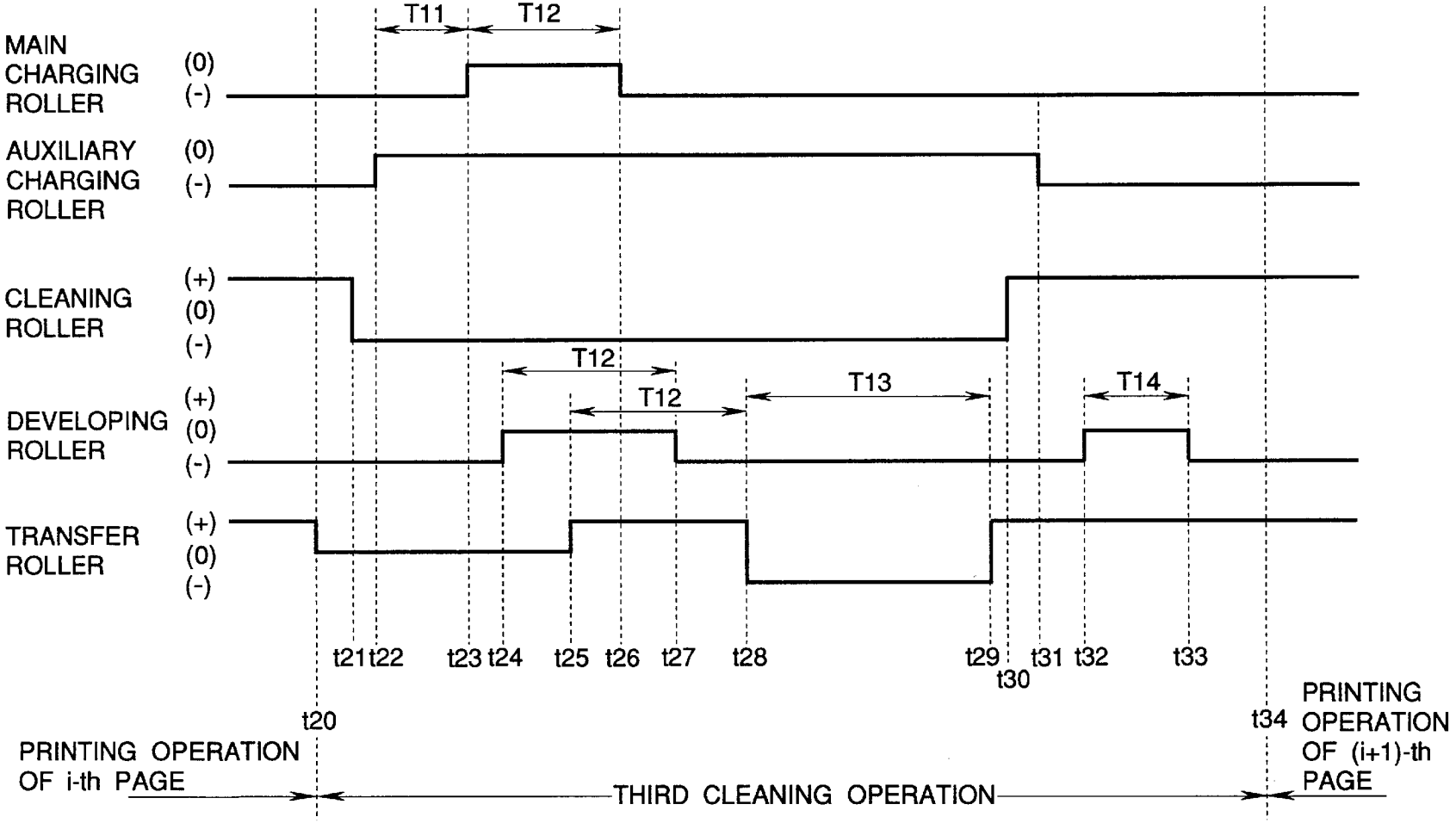
FIG. 13 shows the timing chart for the third cleaning operation.

FIG. 13 shows a timing chart illustrating the operation of the electrophotographic printer according to the third embodiment.

When the printing of the i-th page completes at time t20, the program of FIG. 12 proceeds to step S38 where the third cleaning operation is performed. Then, upon completion of the cleaning operation, the printing of the (i+1)th page is started at time t34. The cleaning operation is performed from time t21 to time t33 and will be described with reference to FIGS. 14A–14D, 15A–15D, 16A–16D, and 17A–17C.

FIGS. 14A–14D, 15A–15D, 16A–16D, and 17A–17C illustrate the cleanings method of the third embodiment and represent the state of the relevant sections at specific timings shown in the timing chart shown in FIG. 13.

Figure 14A:
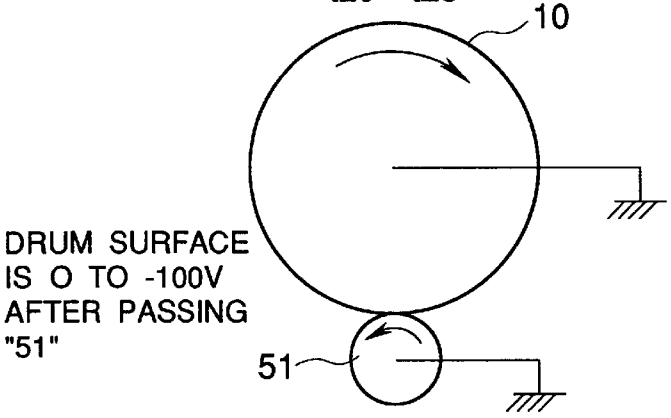
FIGS. 14A–14D, 15A–15D, 16A–16D, and 17A–17C illustrate the cleanings method of the third embodiment, representing the state of the relevant sections at specific timings shown in the timing chart shown in FIG. 13.
Figure 14B:
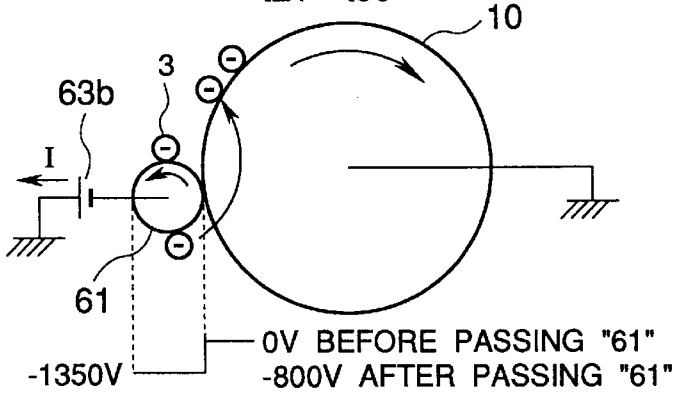

At time t20, the potential of the transfer roller 51 is set to zero volts as shown in FIG. 14A so that the surface potential of the photoconductive drum 10 becomes near zero volts. Then, the area of the photoconductive drum 10 of nearly zero volts approaches the cleaning roller 61 as the photoconductive drum 10 rotates. At time t21 immediately before the area reaches the cleaning roller 61, the cleaning roller 61 is switched to the power supply circuit 63*b* so that the cleaning roller 61 receives a negative voltage of −1350 V. The cleaning roller 61 has the normally-charged toner 3 thereon which is deposited during the printing operation. The normally-charged toner 3 migrates from the cleaning roller 61 to the photoconductive drum 10 with the aid of Coulomb force. The photoconductive drum 10 rotates with the normally-charged toner 3 deposited thereon and the normally-charged toner 3 reaches the main charging roller 21.

Figure 14C:
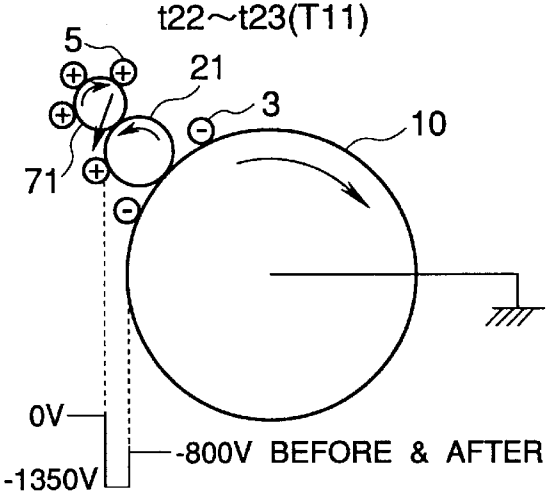
Figure 14D:
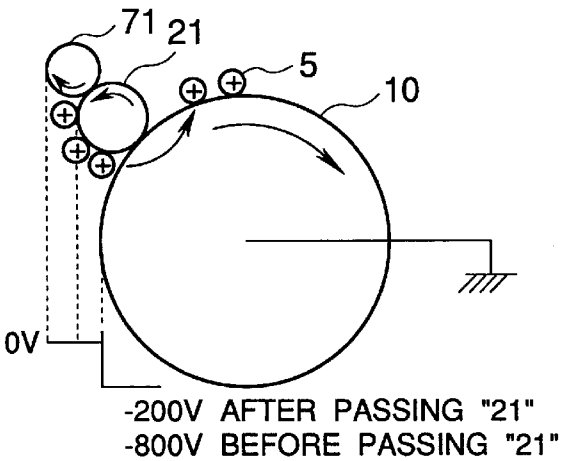

At time t22 immediately before the normally-charged toner 3 on the photoconductive drum 10 reaches the main charging roller 21, the auxiliary charging roller 71 is set to zero volts as shown in FIG. 14C. Thus, the auxiliary charging roller 71 becomes higher in potential than the main charging roller 21 so that the reversely-charged toner 5 deposited on the auxiliary charging roller 71 migrates to the main charging roller 21. Since the photoconductive drum 10 is higher in potential than the main charging roller 21, the normally-charged toner 3 on the photoconductive drum 10 passes the charging section toward the developing section.

The state shown in FIG. 14C continues for a duration T11 which is a time required for one complete rotation of the auxiliary charging roller 71. At the end of the duration T11, i.e., at time t23, the main charging roller 21 is switched to a potential shown in FIG. 14D. In other words, the power supply circuit 22 of the main charging roller 21 is switched off so that the potential of the main charging roller 21 becomes zero volts. The state of FIG. 14D continues for a duration T12. The duration T11 (t22-t23) can be set long, for example, a length of time required for two or three complete rotations of the auxiliary charging roller 71 if an amount of the reversely-charged toner 5 on the auxiliary charging roller 71 is large. Then, the reversely-charged toner 5 migrates from the auxiliary charging roller 71 via the main charging roller 21 toward the photoconductive drum 10.

Figure 15A:
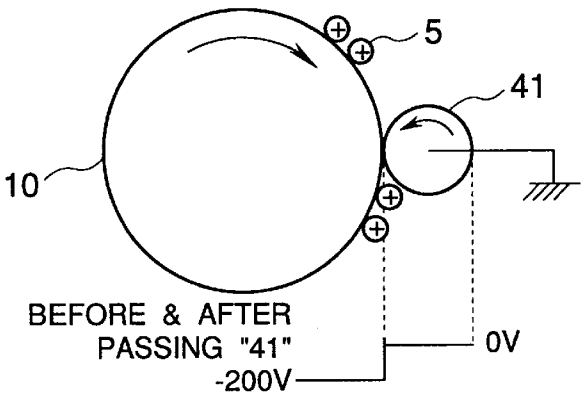

In this manner, the reversely-charged toner 5 that has migrated to the photoconductive drum 10 is carried toward the developing section. At time t24 immediately before the reversely-charged toner 5 reaches the developing section, the power supply circuit 42 is switched from a negative voltage to zero volts as shown in FIG. 15A. Since the photoconductive drum 10 is lower in potential than the developing roller 41, the reversely-charged toner 5 on the photoconductive drum 10 remains on the photoconductive drum 10 and passes the developing section toward the transfer section as the photoconductive drum 10 rotates.

Figure 15B:
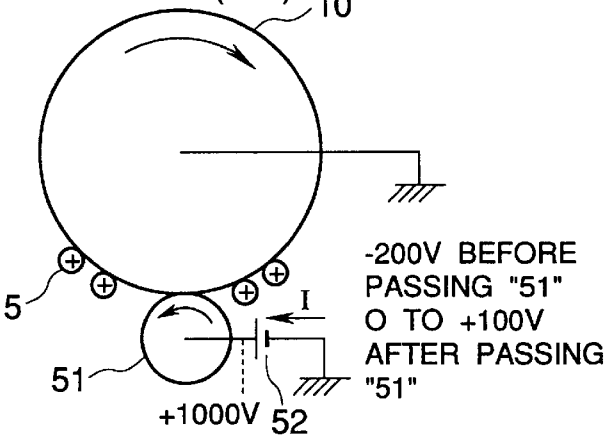

Just before the reversely-charged toner 5 on the photoconductive drum 10 reaches the transfer section, the power supply 52 is switched from zero volts to a positive voltage of +1000 V as shown in FIG. 15B. Thus, the transfer roller 51 becomes higher in potential than the photoconductive drum 10 so that the reversely-charged toner 5 deposited on the photoconductive drum 10 passes the transfer section.

Figure 15C:
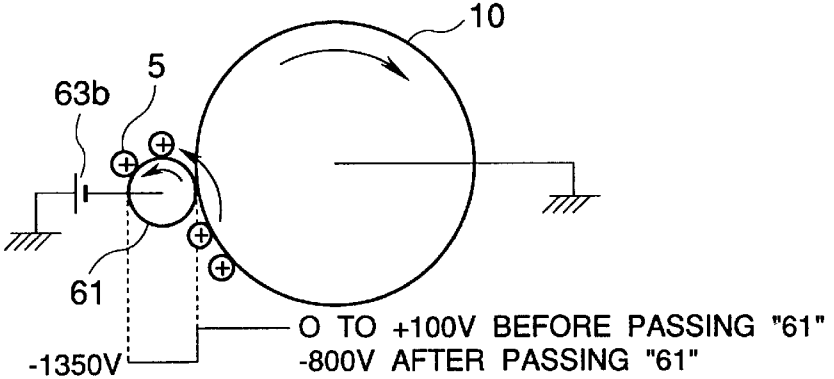

As shown in FIG. 15C, the cleaning roller 61 has been supplied with a negative voltage of −1350 V from the power supply 63*b* since time t21. Therefore, the reversely-charged toner 5 is carried on the photoconductive drum 10 and approaches toward the cleaning section 60. When the reversely-charged toner 5 reaches the cleaning section 60, the reversely-charged toner 5 migrates from the photoconductive drum 10 to the cleaning roller 61 which in turn collects the reversely-charged toner 5.

Figure 15D:
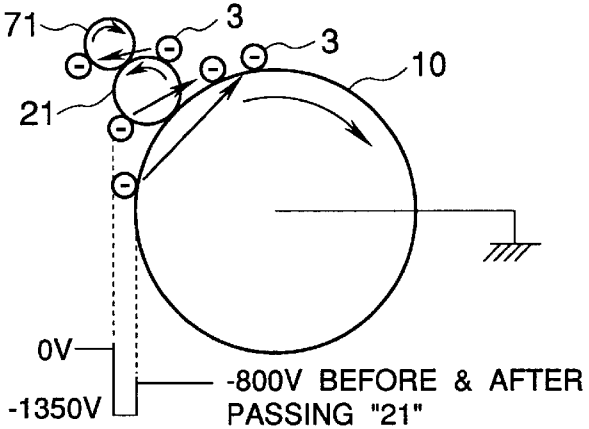
Figure 16A:
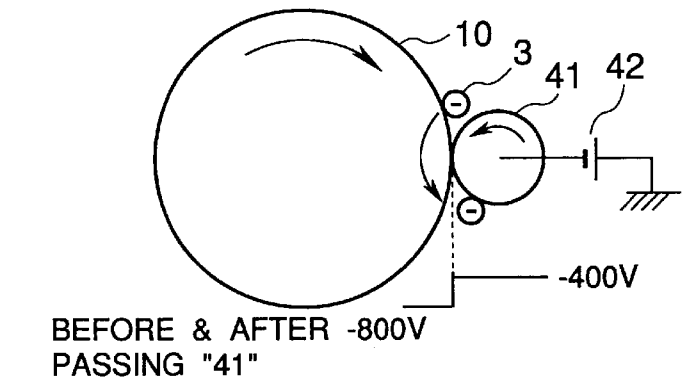

As shown in FIG. 15D, after time t26, the potential of the main charging roller 21 becomes negative. If the some normally-charged toner 3 remains on the surface of the main charging roller 21, the normally-charged toner 3 migrates to the auxiliary charging roller 71 or the photoconductive drum 10 by Coulomb force. The normally-charged toner 3 which has migrated to the photoconductive drum 10 is collected into the developing section at a later time as shown in FIG. 16A. The normally-charged toner 3 collected into the developing section is reused.

At time t27 just before the normally-charged toner 3 deposited on the photoconductive drum 10 reaches the developing section, the developing roller 41 receives a negative voltage. As shown in FIG. 13, when the reversely-charged toner 5 migrates from the main charging roller 21 to the photoconductive drum 10 during the duration T12, the developing roller 41 and transfer roller 51 are set at time t24 and t25, respectively, to higher potentials than the photoconductive drum 10 and remain at those potentials for the duration T12, thereby ensuring that the reversely-charged toner 5 passes the developing section and transfer section. Then, the developing roller 41 and the transfer roller 51 are again switched to negative potentials at the end of the durations T12.

Referring to FIG. 16A, the potential of the developing roller 41 becomes higher than that of the photoconductive drum 10. This is because the photoconductive drum 10 has already been charged by the charging section to a sufficiently low negative potential. Thus, the normally-charged toner 3 deposited on the photoconductive drum 10 is attracted to the developing roller 41 for reuse.

Figure 16B:
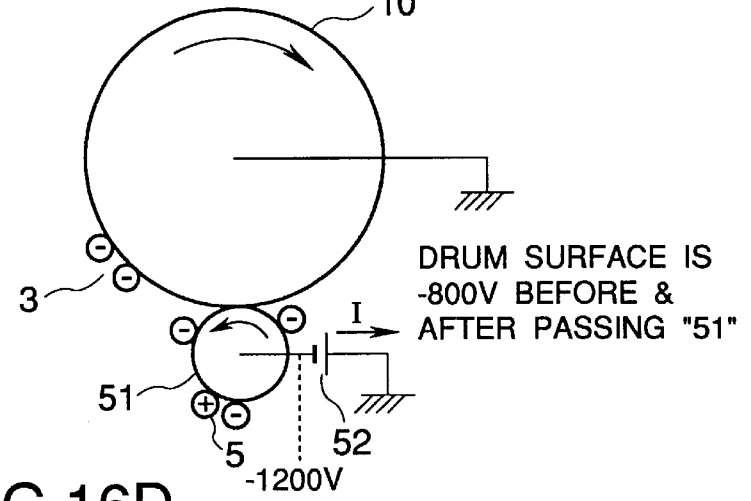
Figure 16C:
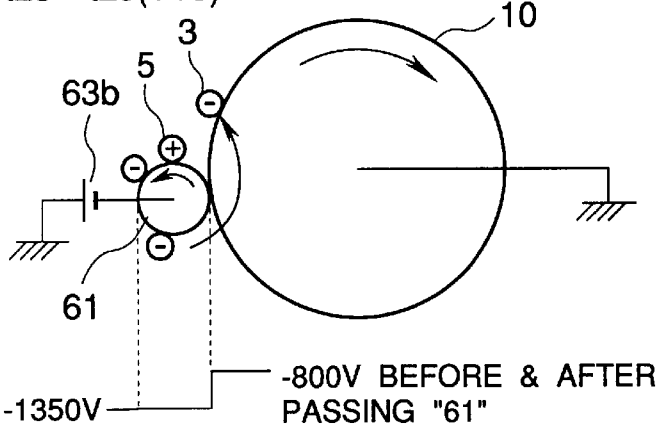

Then, at time t28, the potential of the transfer roller 51 is switched to the negative voltage by the power supply circuit 52 as shown in FIG. 16B, thereby negatively charging the surface of the photoconductive drum 10. When the negatively charged surface of the photoconductive drum 10 reaches the cleaning section as shown in FIG. 16C, there will be no migration of charges since the cleaning roller 61 receives a negative voltage such that the difference in potential between the photoconductive drum 10 and the cleaning roller 61 is not large enough for a discharge to occur. The cleaning roller 61 and photoconductive drum 10 rotate at different circumferential speeds so that one slips over the other at all times, thereby increasing cleaning effect. Triboelectricity resulting from the slippage between the photoconductive drum 10 and the cleaning roller 61 causes the reversely-charged toner 5 deposited on the cleaning roller 61 to be inverted in polarity, with the result that the reversely-charged toner 5 becomes normally-charged toner. The toner inverted from positive to negative migrates to the photoconductive drum 10 and is carried to the developing section for reuse as the photoconductive drum 10 rotates.

In order to ensure that the reversely-charged toner 5 is inverted in polarity with the aid of triboelectrification, a duration T13 shown in FIG. 13 is preferably sufficiently long in accordance with an amount of the reversely-charged toner 5 attracted to the cleaning roller 61.

Figure 16D:
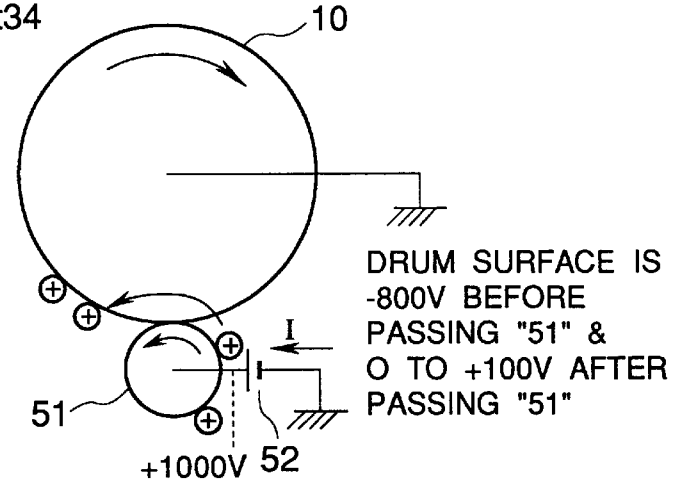
Figure 17A:
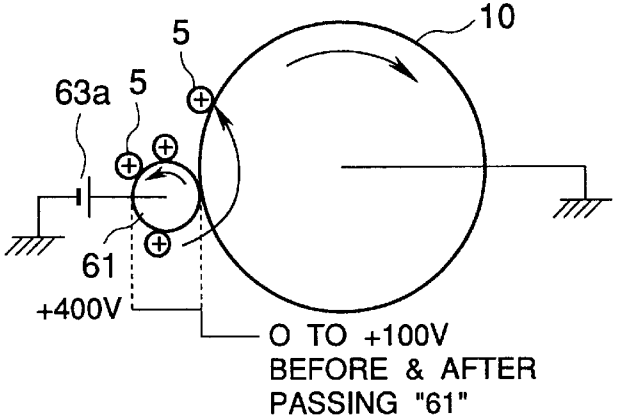

At time t29, the power supply 52 connected to the transfer roller 51 is switched from the negative voltage to the positive voltage as shown in FIG. 16D, thereby causing the surface potential of the photoconductive drum 10 to become nearly zero volts. Thereafter, the surface of the photoconductive drum 10 of nearly zero volts rotates toward the cleaning roller 61. At time t30 immediately before the surface reaches the cleaning roller 61, the cleaning roller 61 is switched to the power supply 63*a* as shown in FIG. 17A.

In this manner, the cleaning roller 61 receives the positive voltage of +400 V so that the reversely-charged toner 5 deposited on the cleaning roller 61 migrates to the photoconductive drum 10 by Coulomb force. The reversely-charged toner 5 deposited on the surface of the photoconductive drum 10 approaches the charging section as the photoconductive drum 10 rotates. At time t31 just before the surface of the photoconductive drum 10 reaches the main charging roller 21, the auxiliary charging roller 71 is switched to the negative voltage (−1700 V) with the result that the auxiliary charging roller 71, main charging roller 21, and photoconductive drum 10 receive progressively high potentials in this order as shown in FIG. 17B.

Figure 17B:
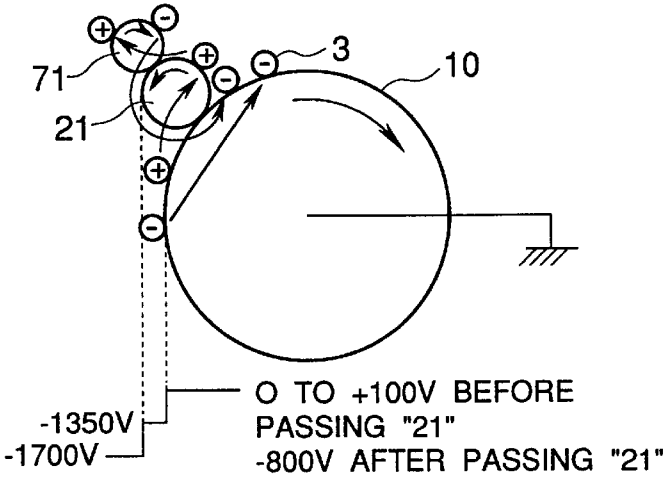

As shown in FIG. 17B, the normally-charged toner 3 on the auxiliary charging roller 71 migrates via the main charging roller 21 to the photoconductive drum 10. Meanwhile the reversely-charged toner on the photoconductive drum 10 migrates via the main charging roller 21 to the auxiliary charging roller 71. The normally-charged toner 3 deposited on the photoconductive drum 10 is carried to the developing section as the photoconductive drum 10 rotates.

Figure 17C:
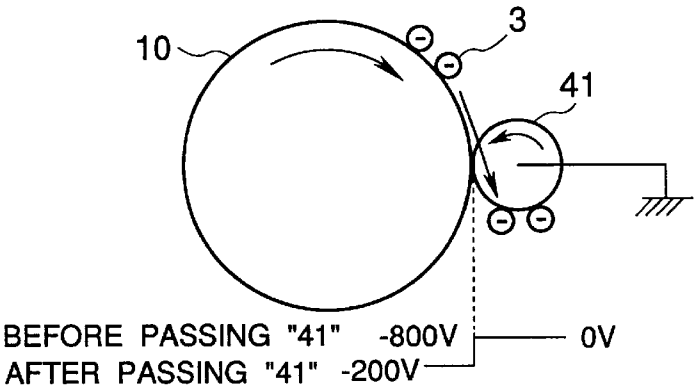

As shown in FIG. 17C, the developing roller 41 is set to zero volts for a duration T14 (t32-t33) during which the all of the normally-charged toner 3 reaches the developing section. The surface of the photoconductive drum 10 has been negatively charged by the main charging roller 21. Thus, the normally-charged toner 3 on the photoconductive drum 10 migrates to the developing roller 41 by Coulomb force, thereby recovering the normally-charged toner 3 into the developing section for reuse. After the aforementioned processes have been performed, the printing operation for the next page is started at time t34.

<Advantages of the Third Embodiment>

According to the third embodiment, a printing operation is monitored so that when a predetermined number of pages have been printed, the third cleaning operation is performed. This way of cleaning prevents excess reversely-charged toner 5 from being deposited on the auxiliary roller 71 when printing operations are performed successively. The printing operations can be interrupted by the cleaning operations at a timing which is set in accordance with various kinds of parameters such as the number of printed pages, the number of rotations of the photoconductive drum, or cumulative time required for printing. If there is any means that can directly measure an amount of accumulated reversely-charged toner 5, then the printing can be interrupted when such an accumulated amount of toner reaches a predetermined value.

In the third embodiment, the reversely-charged toner is inverted in polarity by triboelectrification using the fact that the cleaning roller rotates in slipping engagement with the photoconductive drum. Thus, the reversely-charged toner accumulated on the cleaning roller can be recovered as much as possible into the developing section for reuse.

The aforementioned embodiments have been described with respect to specific voltage values but the voltages are only exemplary and can be changed to some extent as required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of cleaning an electrophotographic printer having a charging section which charges a rotating photoconductor, the charging section having a main charging device and an auxiliary charging device, the main charging device having a first area in electrical contact with the photoconductor and a second area in electrical contact with the auxiliary charging device;

wherein when a printing operation is being performed, the method includes the steps of:

applying potential differences among the main charging device, the auxiliary charging device, and the photoconductor, the potential differences being such that reversely-charged toner having a polarity opposite to normally-charged toner and being deposited on the photoconductor migrates from the photoconductor to the main charging device via the first area by Coulomb force, then said reversely-charged toner migrates from the main charging device to the auxiliary charging device via the second area by Coulomb force; and wherein when a cleaning has been started,the method includes the steps of:

applying a potential difference between the auxiliary charging device and the main charging device, the potential difference being such that said reversely-charged toner deposited on the auxiliary charging device migrates from the auxiliary charging device to the main charging device via the second area by Coulomb force; and applying a potential difference between the photoconductor and the main charging device, the potential difference being such that said reversely-charged toner deposited on the main charging device migrates from the main charging device to the photoconductor via the first area by Coulomb force; and wherein when said reversely-charged toner that has been deposited on the surface of the photoconductor due to Coulomb force reaches a cleaning section as the photoconductor rotates, the cleaning section being disposed downstream of the charging section, the method includes the step of:

applying a potential difference between the photoconductor and the cleaning section having a third area in electrical contact with the photoconductor, the potential difference being such that said reversely-charged toner migrates from the photoconductor to the cleaning section via the third area by Coulomb force.

2. The method according to claim 1, wherein when the cleaning is being performed, if the normally-charged toner migrates from the photoconductive drum via the main charging device to the auxiliary charging device and is deposited on the auxiliary charging device during migration of said reversely-charged toner from the auxiliary charging device via the main charging device to the main charging device, the method further includes the steps of:

applying a potential difference between the auxiliary charging device and the main charging device, the potential difference being such that said normally-charged toner deposited on the auxiliary charging device migrates from the auxiliary charging device to the main charging device via the second area by Coulomb force; and applying a potential difference between the photoconductor and the main charging device, the potential difference being such that said normally-charged toner migrates from the main charging device to the photoconductor via said first area by Coulomb force; and wherein when said normally-charged toner that has been deposited on the surface of the photoconductor by Coulomb force reaches a developing section as the photoconductor rotates, the developing section being disposed downstream of the charging section and upstream of the cleaning section, the method includes the step of:

applying a potential difference between the photoconductor and the developing section having a fourth area in electrical contact with the photoconductor, the potential difference being such that said normally-charged toner migrates from the photoconductor to the developing section via the fourth area by Coulomb force, whereby said normally-charge toner is recovered into the developing section.

3. The method according to claim 1, wherein if said normally-charged toner migrates from the photoconductor to a transfer section and said normally-charged toner is deposited on the transfer section during travel of said reversely-charged toner passing the transfer section toward the cleaning section, the transfer section being disposed downstream of the developing section and upstream of the cleaning section and having a fifth area in electrical contact with the photoconductor, the method further includes the step of:

applying a potential difference between the transfer section and the photoconductor, the potential difference being such that the normally-charged toner on the transfer section migrates from the transfer section to the photoconductor via the fifth area by Coulomb force.

4. The method according to claim 1 further including a step of:

monitoring a parameter indicative of an amount of said reversely-charged toner deposited on the auxiliary charging device during printing; and performing the cleaning when the parameter reaches a predetermined state.

5. The method according to claim 1, further including the steps of:

if said reversely-charged toner is deposited to the cleaning section, inverting said normally-charged toner in polarity by triboelectrification at the third area so that polarity-inverted toner migrates from the cleaning section to the photoconductor; and when said normally-charged toner that has been deposited on the surface of the photoconductor by Coulomb force reaches a developing section as the photoconductor rotates, the method includes the step of:

applying a potential difference between the photoconductor and the developing section having a fourth area in contact with the photoconductor, the potential difference being such that said normally-charged toner migrates from the photoconductor to the developing section via the fourth area by Coulomb force.

* * * * *